US007976317B2

(12) United States Patent
Patel et al.

(10) Patent No.: US 7,976,317 B2
(45) Date of Patent: Jul. 12, 2011

(54) LOW PROFILE MODULAR ELECTRICAL CONNECTORS AND SYSTEMS

(75) Inventors: Arvind Patel, Naperville, IL (US); Bratislav Kostic, Elmhurst, IL (US); Daniel McGowan, Naperville, IL (US); Kenneth Stead, Aurora, IL (US); Mark M. Data, Bolingbrook, IL (US)

(73) Assignee: Molex Incorporated, Lisle, IL (US)

( * ) Notice: Subject to any disclaimer, the term of this patent is extended or adjusted under 35 U.S.C. 154(b) by 37 days.

(21) Appl. No.: 11/999,069

(22) Filed: Dec. 4, 2007

(65) Prior Publication Data

US 2009/0142953 A1 Jun. 4, 2009

(51) Int. Cl.
*H01R 12/00* (2006.01)

(52) U.S. Cl. ..... 439/79; 439/699.1

(58) Field of Classification Search ..... 439/79, 439/80, 680, 699.1, 746, 947
See application file for complete search history.

(56) References Cited

U.S. PATENT DOCUMENTS

| | | | | |
|---|---|---|---|---|
| 3,596,235 | A | 7/1971 | Hendriklaan | |
| 4,790,763 | A | 12/1988 | Weber et al. | |
| 4,845,589 | A | 7/1989 | Weidler et al. | |
| 4,881,905 | A | 11/1989 | Demler, Jr. et al. | |
| 5,221,210 | A * | 6/1993 | Bormuth et al. | 439/79 |
| 5,575,690 | A * | 11/1996 | Eaton | 439/717 |
| 5,584,728 | A | 12/1996 | Cheng | |
| 5,618,187 | A | 4/1997 | Goto | |
| 5,667,392 | A | 9/1997 | Kocher et al. | |
| 5,951,306 | A | 9/1999 | Millhimes | |
| 6,059,615 | A | 5/2000 | Pendleton et al. | |
| 6,299,492 | B1 * | 10/2001 | Pierini et al. | 439/884 |
| 6,319,075 | B1 | 11/2001 | Clark et al. | |
| 6,402,566 | B1 * | 6/2002 | Middlehurst et al. | 439/699.1 |
| 6,604,967 | B2 | 8/2003 | Middlehurst et al. | |
| 6,666,698 | B2 | 12/2003 | Beck, Jr. et al. | |
| 6,780,027 | B2 | 8/2004 | Allison | |
| 6,814,590 | B2 | 11/2004 | Minich et al. | |
| 6,848,950 | B2 * | 2/2005 | Allison et al. | 439/682 |
| 6,848,953 | B2 | 2/2005 | Schell et al. | |
| 6,869,294 | B2 * | 3/2005 | Clark et al. | 439/79 |
| 6,890,221 | B2 | 5/2005 | Wagner | |
| 6,930,889 | B2 | 8/2005 | Harrison et al. | |
| 6,969,268 | B2 | 11/2005 | Brunker et al. | |
| 7,059,919 | B2 | 6/2006 | Clark et al. | |

(Continued)

FOREIGN PATENT DOCUMENTS

EP 0 951 102 A2 10/1999

(Continued)

OTHER PUBLICATIONS

International Search Report for PCT/US2008/085358.

*Primary Examiner* — Thanh-Tam T Le
(74) *Attorney, Agent, or Firm* — Stephen L. Sheldon

(57) ABSTRACT

Power connector modules are provided that can be plug connectors, receptacle connectors, or a system of plug and receptacle connector modules and optionally other modules, that mate together. Each connector has an uncoupled contact feature. The uncoupled contacts have exposed surfaces to dissipate heat resulting from Joule effects. The uncoupled contacts for the plug connector converge to form a blade structure at one side. The uncoupled contacts for the receptacle connector form a receiving section that engages the blade structure of the plug connector when the plug connector and receptacle connector are used together.

15 Claims, 25 Drawing Sheets

U.S. PATENT DOCUMENTS

| | | | | |
|---|---|---|---|---|
| 7,070,464 | B2 | 7/2006 | Clark et al. | |
| 7,168,963 | B2 | 1/2007 | Minich et al. | |
| 7,374,436 | B2 * | 5/2008 | Schell et al. | 439/79 |
| 2005/0136713 | A1 | 6/2005 | Schell et al. | |
| 2006/0166536 | A1 | 7/2006 | Northey et al. | |
| 2006/0194481 | A1 | 8/2006 | Clark et al. | |

FOREIGN PATENT DOCUMENTS

| | | | |
|---|---|---|---|
| WO | WO 96/13879 | A1 | 5/1996 |

* cited by examiner

LOW PROFILE MODULAR ELECTRICAL CONNECTORS AND SYSTEMS

BACKGROUND OF THE INVENTION

The present invention generally relates to electrical power connectors that are useful as low-profile board-to-board connectors and wire-to-board connectors and that can provide excellent operation under high current density conditions and are particularly suitable for use as modular components within modular assemblies.

DESCRIPTION OF BACKGROUND ART

It is desired to improve power connectors such as by reducing the size of the connectors and the space they take when connected, for example, to the surface of a board component such as to a printed circuit board (PCB). Increasing current density can contribute to reducing the size of a power connector, but heat generated by the Joule effect can have negative effects. The heat can cause a temperature rise of the contacts that adversely affects electrical characteristics and expands the contacts. With temperature cycling over time, the expansion effects can lead to loosened contacts or other metal components such as connector screws. There is an overall need to improve power connectors by decreasing size without requiring power reduction while addressing undesired temperature affects.

Prior art approaches include U.S. Pat. No. 4,845,589, which relates to bus bar connectors and addresses undesired effects due to temperature cycling owing to heat generation. The patent describes an electrical power connector having two exposed sidewalls that merge with a support structure to form a U-shaped structure. Extending from the two exposed sidewalls are spring contact arms that mate with a bus bar. A sliding structure is provided with the objectives of allowing easy access to the power connector and correcting problems resulting from temperature cycling. U.S. Pat. No. 5,618,187 pertains to a bus bar contact for mounting on a circuit board comprising a U-shaped center section, contact fingers, termination posts and stabilizing tabs. The U-shaped center section of the bus bar contact has two exposed parallel panels. U.S. Pat. No. 6,666,698 describes air gaps between terminals that are susceptible to arcing. The patent describes mechanical means which is said to impart higher mating and unmating velocities to diminish arcing in high volt systems. U.S. Pat. No. 6,930,889 relates to a circuit board and a slot connector assembly. The patent describes a circuit board comprised of a substrate and electrical contacts wherein the electrical contacts mate with contact springs of a slot connector.

Other prior art includes the following. U.S. Pat. No. 6,319,075 pertains to electrical connectors and more particularly to electrical power connectors said to be useful in circuit board or backplane interconnection systems. This patent describes electrical terminals comprising a pair of spaced apart planar walls having a bridging structure extending between and joining the walls. The bridging structure has forward and rearward bridging elements or a bridging element having an open upper section for heat dissipation. U.S. Pat. No. 6,780,027 relates to electrical connectors for transmitting electrical power. This patent is directed to an electrical connector having both an aperture for engagement with a complementary contact and a protruding tab for engagement with an AC cable plug. U.S. Pat. No. 6,848,950 is directed to power contacts employed in electrical connectors that transmit electrical power. The patent describes two-piece electrical contacts having three electrical interfaces. One electrical interface uses the walls of the two pieces to mate with an electrical connector; another interface has terminals or tails extending from the contact to engage a circuit board; and a third interface is a plug projection for engaging a cable plug. The patent further describes an electrical connector comprising a first power contact providing both a cable-to-board interface and a board-to-board interface. This patent also describes an electrical connector having a power contact with a first wall and a second wall wherein the first wall and the second wall are coupled. The electrical connector also has a second power contact with a third wall and a fourth wall wherein the third wall and the fourth wall are uncoupled. U.S. Pat. No. 6,848,953 describes an electrical connector, particularly electrical power connectors said to be useful in circuit board or backplane interconnectors. The patent discusses a contact with two opposing sidewalls having a bridge extending between the sidewalls and a clip extending from the bridge for engaging the arm of a bus bar.

The following patents describe other prior art proposals. U.S. Pat. No. 6,869,294 pertains to matable electrical connectors having power capabilities. The patent discloses a plug connector having a substantially U-shaped electrically conductive body. Three open sides and three closed sides define the body. The three closed sides comprise two side walls and an upper bridging element. U.S. Pat. No. 6,890,221 pertains to a matable electrical connector in a housing. This approach requires a receptacle connector comprising a pair of spaced receptacle contact walls and a plug connector comprised of a pair of spaced plug contact walls wherein both the receptacle connector and the plug connector are in the same housing. U.S. Pat. No. 7,059,919 pertains to an electrical connector, particularly electrical power connectors said to be useful in circuit board or backplane interconnectors. The patent discusses a pair of flexible beams that extend from a pair of opposed contact side walls. The flexible beams are widthwise tapered in a direction from which the beams extend. The flexible beams also extend outwardly away from each other and inwardly towards each other. An unobstructed heat flow path is defined between the flexible beams. U.S. Pat. No. 7,070,464 pertains to electrical connectors, particularly electrical power connectors said to be useful in circuit board or backplane interconnectors. The patent describes a pair of opposed contact walls having a bridging element adjoining the opposed contact walls. The patent discusses two opposed contact walls each having panels and flexible beams extending from the panels. The flexible beams extend outwardly away from each other and inwardly toward each other.

Prior art including some of that discussed hereinabove describes power connectors that use coupled contacts wherein a cumbersome and restrictive bridging element connects two contacts. The bridging elements take up space, restrict air flow and hinder flexible use of contacts. The power connector of this invention employing uncoupled contacts has a low profile but sufficient height to provide good air flow within the connectors. The power connectors as described herein have low profiles with only slight or moderate temperature rise during extended use. Advantageously, board space is saved, the power connectors providing about 30 to about 60 amps per blade and typically about 45 to about 55 amps per blade, equating to between about 120 and about 300 amps per inch and typically between about 180 and about 275 amps per inch.

With the present approach, it has been determined that various characteristics of prior art such as these patents may have shortcomings such as these and undesirable attributes, results or effects. The present approach recognizes and addresses matters such as these to provide enhancements not heretofore available. Overall, the present approach more fully meets the persistent need for smaller power connectors to accommodate more power with limited temperature rise and limited space requirements.

SUMMARY OF THE INVENTION

One aspect or embodiment of the invention relates to improved power connectors that have an insulative housing.

These housed power connectors have improved and lower. profiles, typically 30% less than commercial housed power connectors with similar power performance. The improved power connectors can include plug connectors and receptacle connectors for mating with each other or other components. The power connector, the receptacle connector or both may comprise two uncoupled contacts seated in cavities in the housing. The contacts have exposed surfaces to dissipate heat resulting from Joule effects, and the cavities are constructed with openings and/or spacings to improve air flow in one or more of the top, bottom, bottom and/or rear of the connector cavities. Improved airflow permits higher current density without unacceptable temperature rise and contributes to providing power connectors that have a low profile with no sacrifice of quality or power handling capabilities.

In another aspect or embodiment, the use of uncoupled walls eliminates a bridging structure that is used in some prior art approaches to couple and hold two contact walls in position relative to one another. The bridging structure typically needs space on the topside of the contact walls adding to the connector height and profile. Eliminating the space required when a bridging structure is included contributes to a lower connector profile.

According to another aspect or embodiment, the uncoupled contacts can employ small barbs on the sides of the contacts to assist in holding the contacts in place. According to one approach, a barb is positioned on a side, such as near the bottom of a contact to ride on a shoulder of the housing and lock in the contact vertically. According to another approach, a barb near the top of a contact locks the contact into a housing channel to lock in the contact horizontally. Each barb adds little if anything to connector profile. Typically both barb arrangements will be used to provide secure positioning in two dimensions.

According to a further aspect or embodiment, the mating sections of the contacts for the plug connector form a blade structure, and the mating sections of the contacts for the receptacle connector typically have multiple contact beams for parallel path current flow to minimize resistance and heat generation in order to aid in employing higher current densities. The multiple contact beams form a receiving section that has camming portions for blade entrance and restriction portions for tight blade contact.

In accordance with another aspect or embodiment, and for ease of mating and facilitating of modular assemblies, one mating connector can have guide posts and the other mating connector can have guide apertures to receive the guide posts. The guide posts and apertures can be placed on top of the connectors which typically preserves board space or can be placed the side of the connectors for enhanced air flow.

DETAILED DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
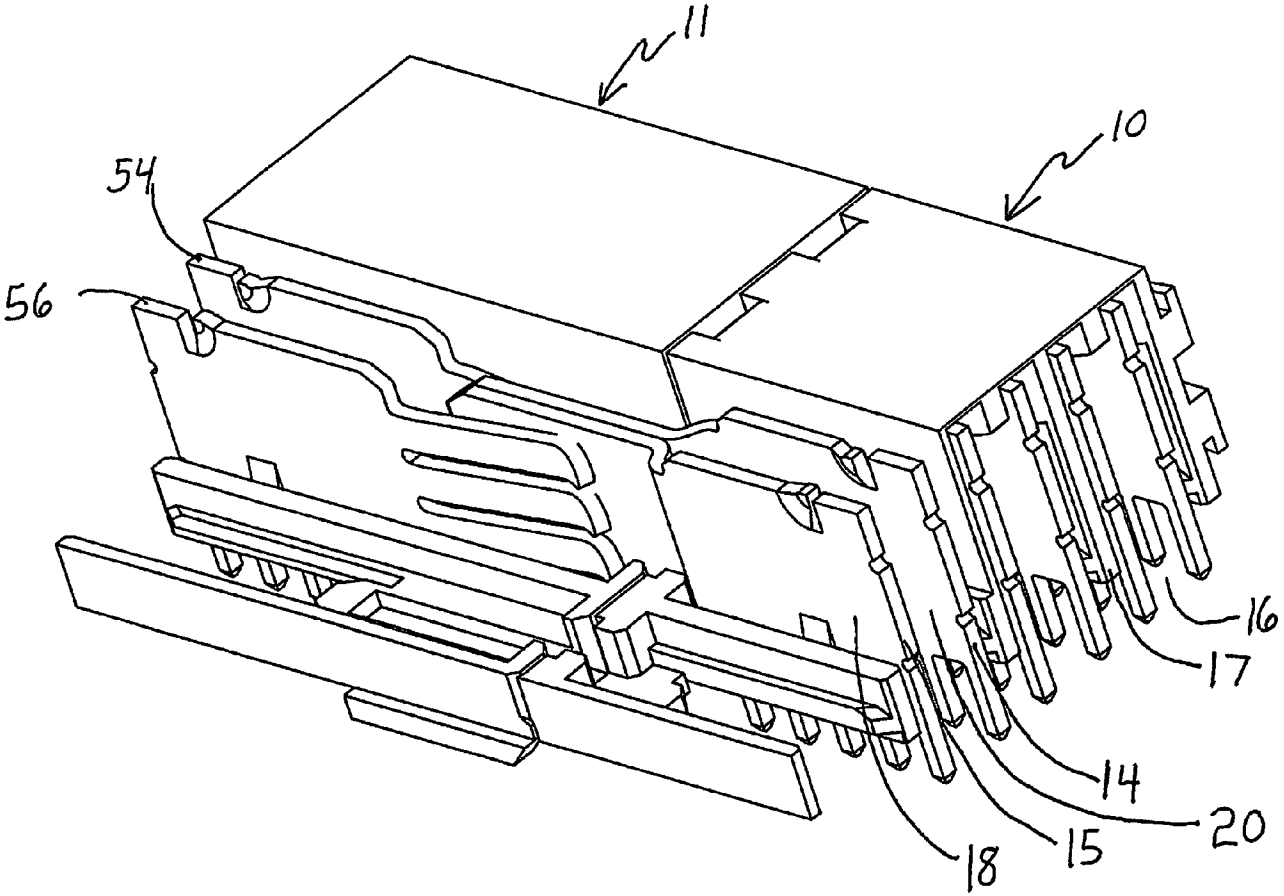
FIG. 1 is a perspective view, partially broken away, of an embodiment of a plug connector coupled to a receptacle connector.
Figure 1A:
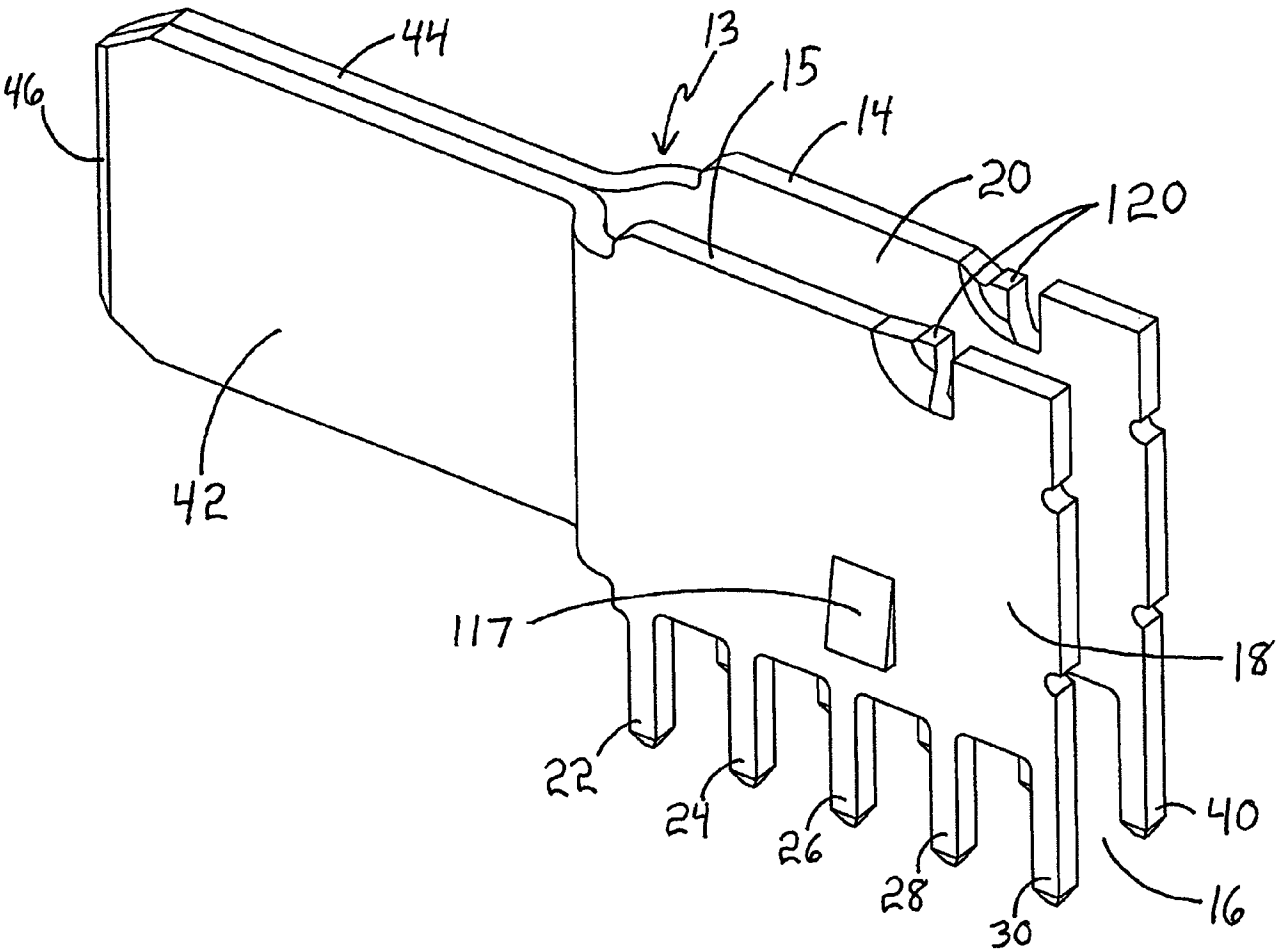
FIG. 1A is a perspective view of a contact pair of the plug connector shown in FIG. 1.
Figure 1B:
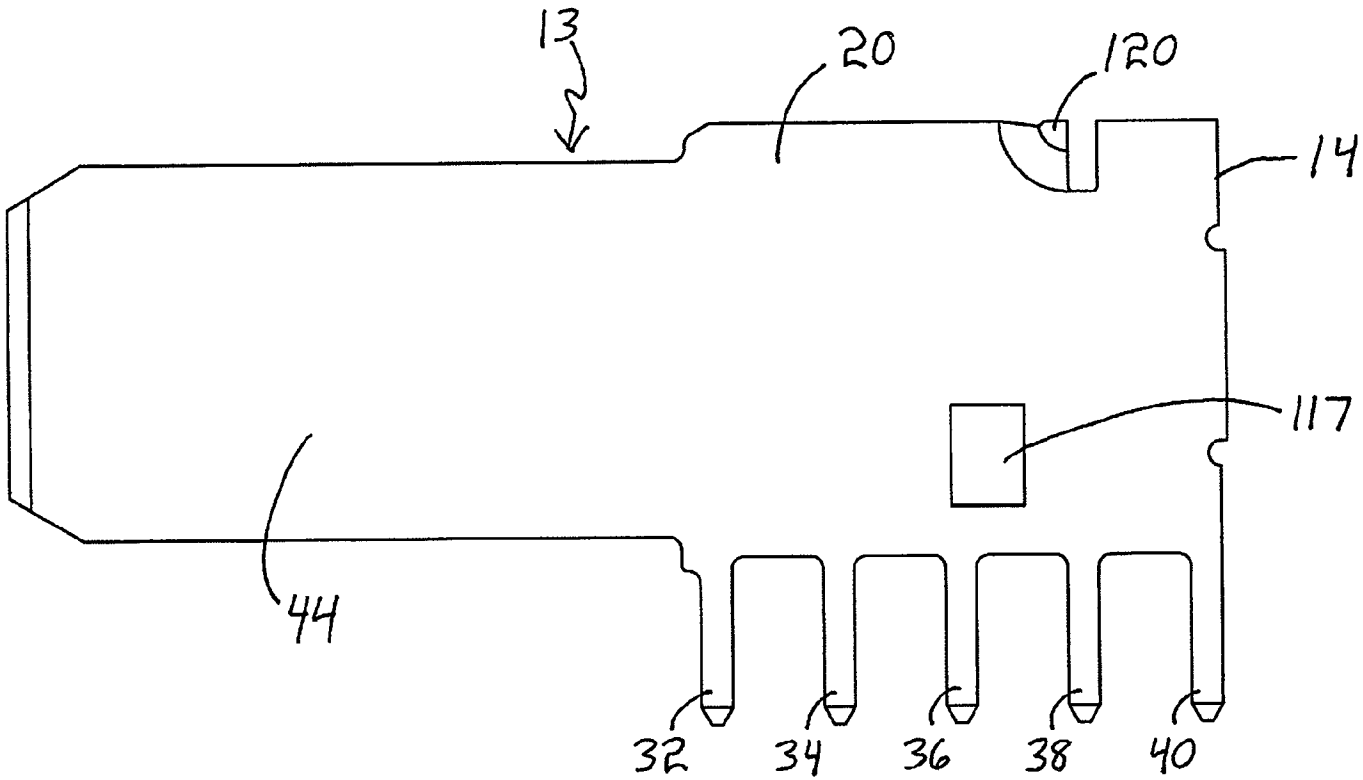
FIG. 1B is a side elevational view of a contact as in FIG. 1A.
Figure 3:
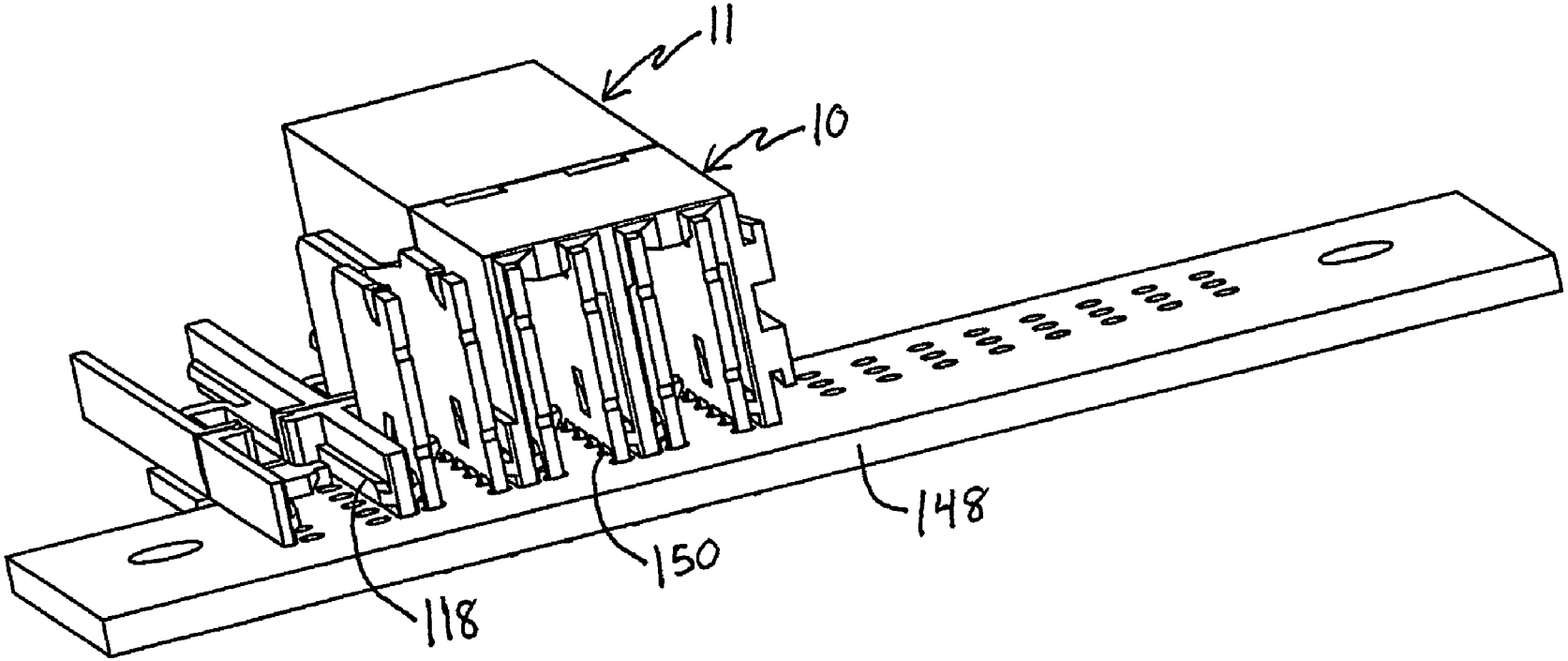
FIG. 3 is a detailed perspective view of the plug connector of FIG. 1, shown connected with a printed circuit board.

FIG. 1 illustrates a plug connector, generally designated at 10, and a receptacle connector, generally designated at 11. These are suitable for use as power connector components. The term power connector is meant to encompass AC power connectors and/or DC power connectors. The plug connector 10 illustrated in FIG. 1 includes a contact, generally designated at 13, comprising a pair of mechanically uncoupled contact members, generally designated at 14 and 15. The contact 13 is held in place by a plug connector insulative housing 17, cut away at some of the contacts shown in this FIG. 1. Contact members 14 and 15 have back panels or body panels 18 and 20, respectively. Panels 18 and 20 are substantially parallel to each other and form a medial space 16 between them. As seen in FIGS. 1, 1A and 1B, extending from the bottom of back panels 18 and 20 are tails 22, 24, 26, 28 and 30 and tails 32, 34, 36, 38 and 40, respectively, for insertion into a printed circuit board (PCB) 148 (FIG. 3). After insertion, the tails may be soldered in place.

Figure 2:
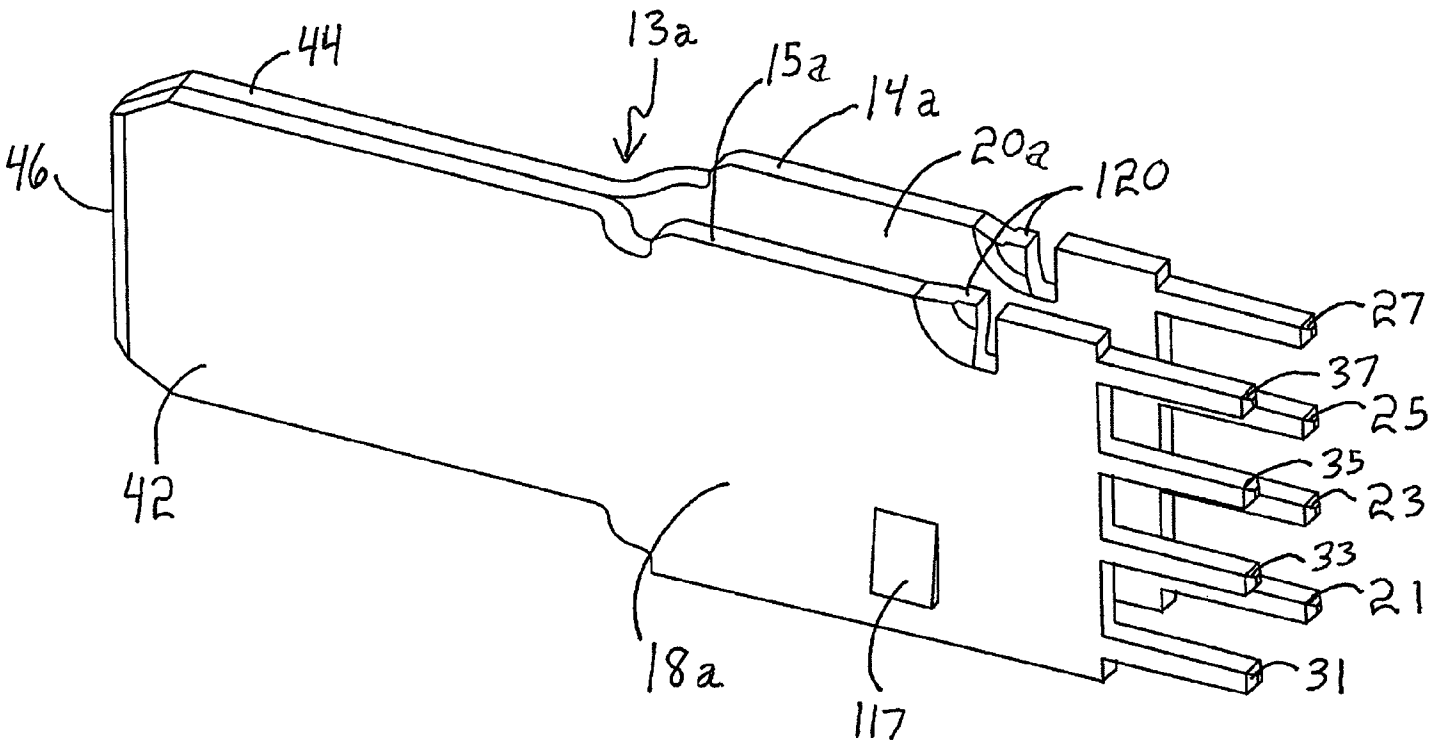
FIG. 2 is a perspective view of another embodiment of a plug contact having two uncoupled plug contact members.

Also extending from back panels or body panels 18 and 20 are beams 42 and 44, respectively. In some embodiments, such as shown in FIGS. 1, 1A and 1B, beams 42 and 44 which are mechanically uncoupled and extend from sides of the panels 18 and 20 that are orthogonal to the sides of panels 18 and 20 from which the tails extend. The tails in this embodiment are typically solder tails and compliant tails. In other embodiments such as the one shown in FIG. 2, where a contact 13*a* is shown, there are uncoupled contact members 14*a* and 15*a*. These contact members include back or body panels 18*a* and 20*a*, which have tails 21, 23, 25 and 27 and tails 31, 33, 35 and 37, respectively, that extend from these back panels in a direction generally opposite to or in line with the respective beams 42 and 44. The tails in this embodiment typically are solder tails and compliant tails.

Figure 4:
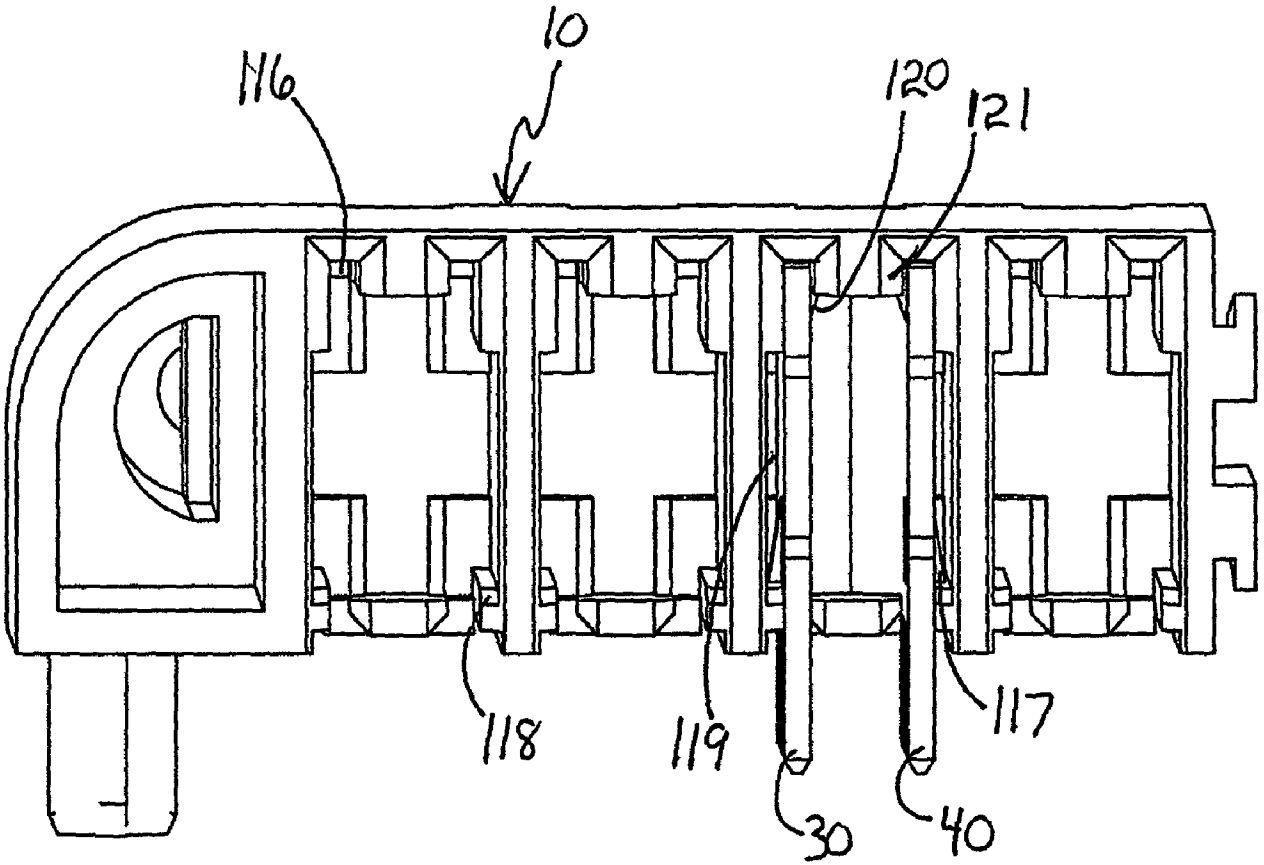
FIG. 4 is a detailed elevational view of the plug connector of FIG. 1, showing engagement and spacing between the contact and components of the housing.

Whether the tails are oriented generally orthogonal or generally in line with the beams and blade formed therefrom, the blade extends from back panel or body panel pairs or contact members 18, 20 or 18*a*, 20*a*. Viewed in the direction out of the plug connector, and toward the receptacle connector (or outwardly), beams 42 and 44 extend from the back or body panels first in an inward direction toward each other until they meet, and then they are parallel to each other, typically in contact with each other along this length. The outwardly extending section of the beams 42 and 44 form blade 46, which is the mating portion of the contacts 13 of the plug connector 10. As seen in FIGS. 3 and 4, described in greater detail hereinafter, barbs 117 and 120 can be provided to cooperate with members of the housing such as housing shoulders or projections 118, to maintain the contact members 14, 15 in place and/or to provide housing channel 116 or open volume 119 along a face of a contact member.

Figure 5:
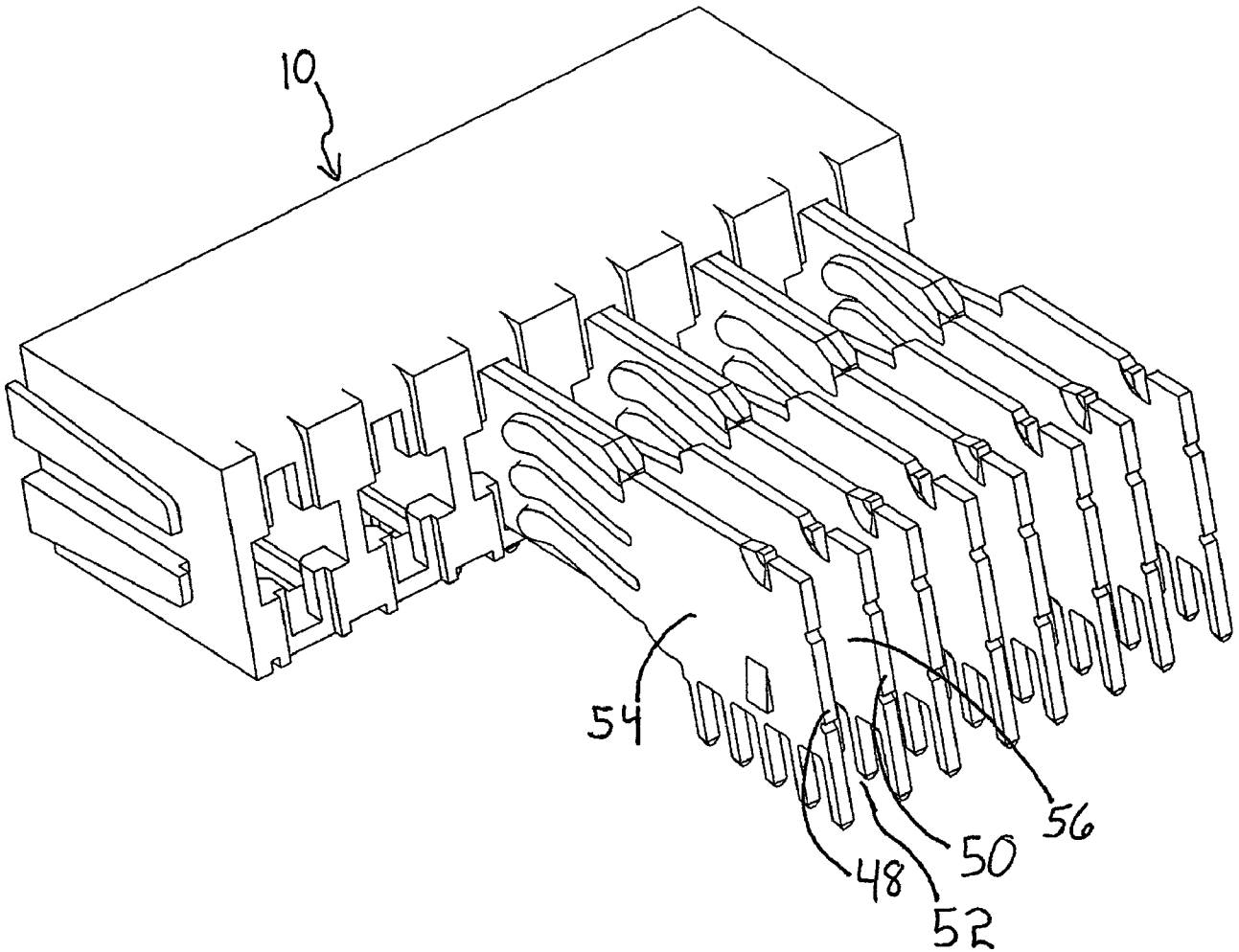
FIG. 5 is a perspective view of a plug connector and of an embodiment of a receptacle connector, partially broken away, such as shown in FIG. 1.

Receptacle connector, generally designated at 11 in FIG. 1 and with its housing removed in FIG. 5, has contacts, generally designated at 47, each having two spaced apart uncoupled contact members 48 and 50 forming a medial space 52 between contact members 48 and 50. Contacts members 48 and 50 have back panels or body panels 54 and 56, respectively, that are substantially parallel to each other. Extending from the bottom of panels 54 and 56 are tails 57, 59, 61, 63 and 65 and tails 66, 68, 70, 72 and 74, respectively, for insertion into a PCB. After insertion, the tails may be soldered in place. Also extending from panels 54 and 56 are beams 76, 78 and 80 and beams 82, 84 and 86, respectively.

Figure 5A:
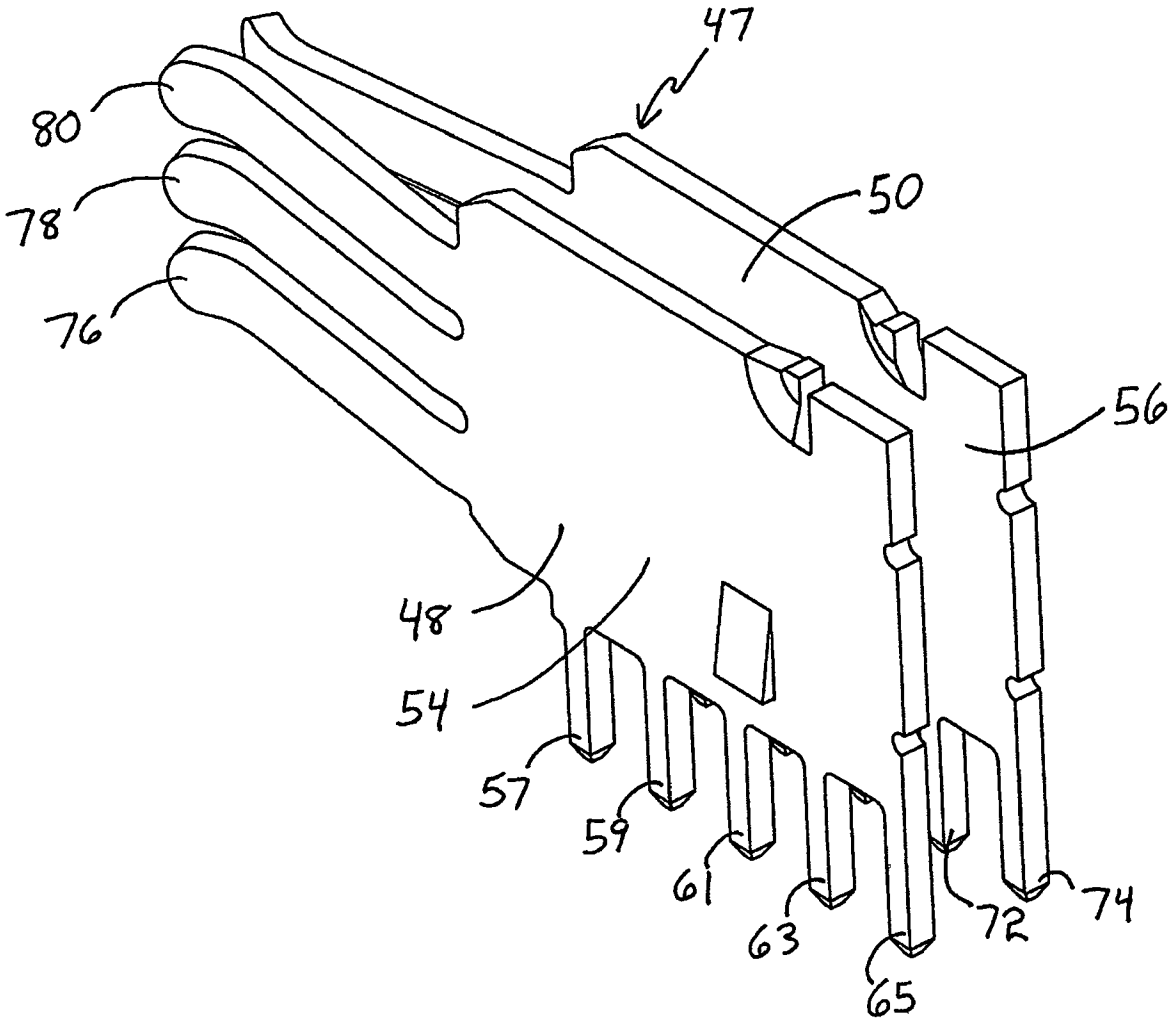
FIG. 5A is a perspective view of an embodiment of an uncoupled receptacle contact pair.
Figure 5B:
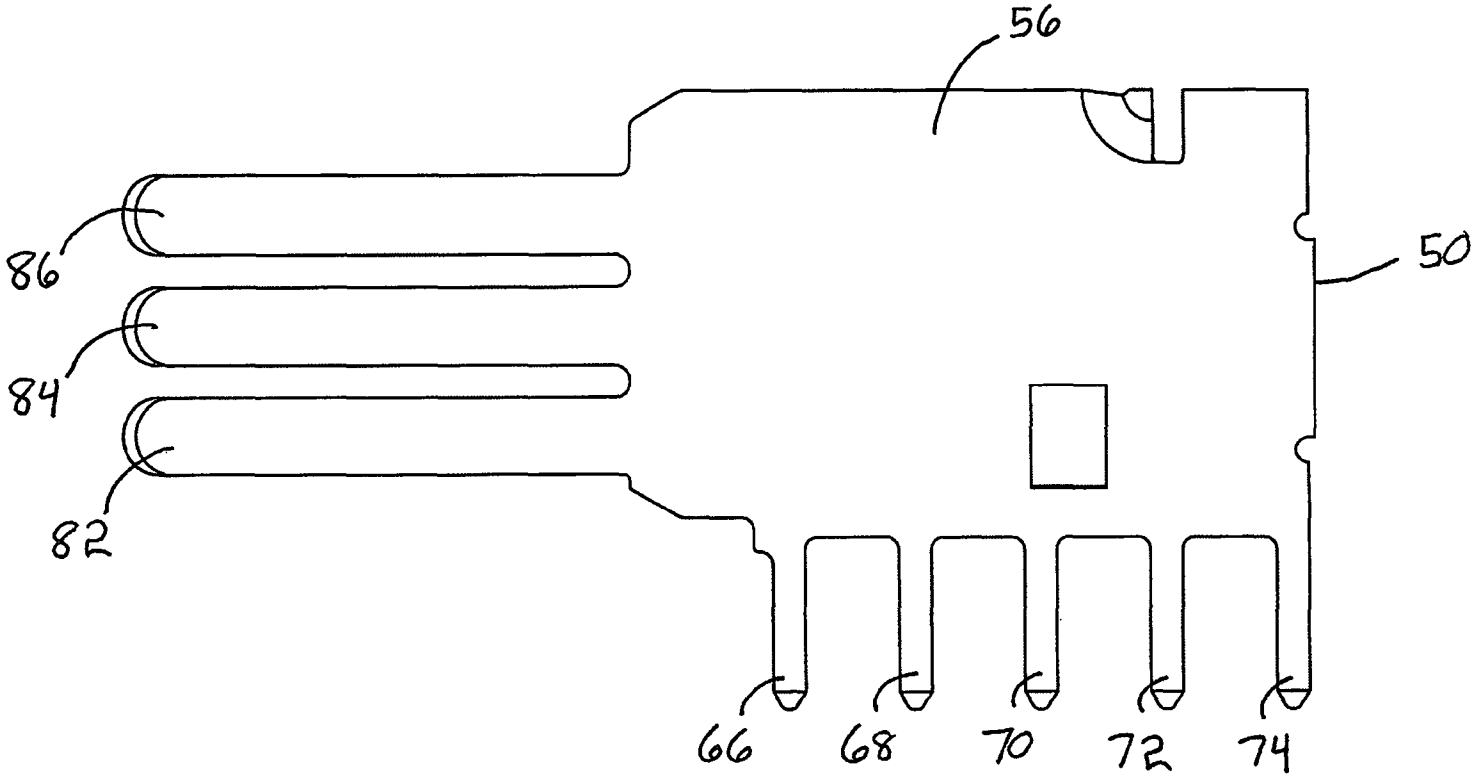
FIG. 5B is a side elevational view of a receptacle contact member of the contact pair as in FIG. 5.
Figure 5C:
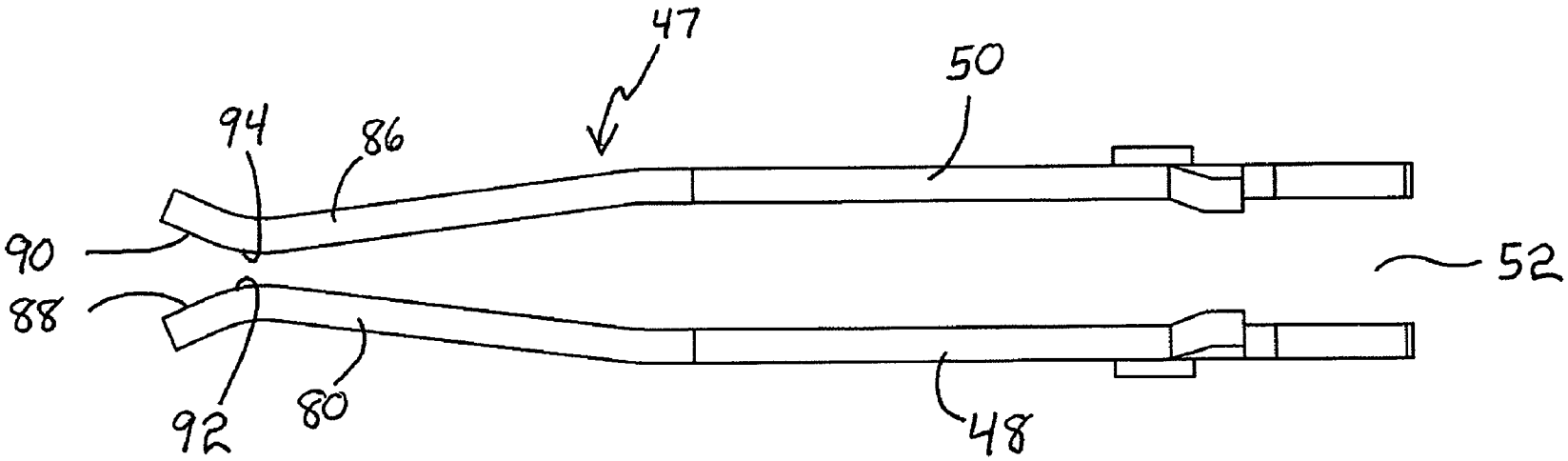
FIG. 5C is a top plan view of an uncoupled receptacle contact pair as in FIG. 5.
Figure 6:
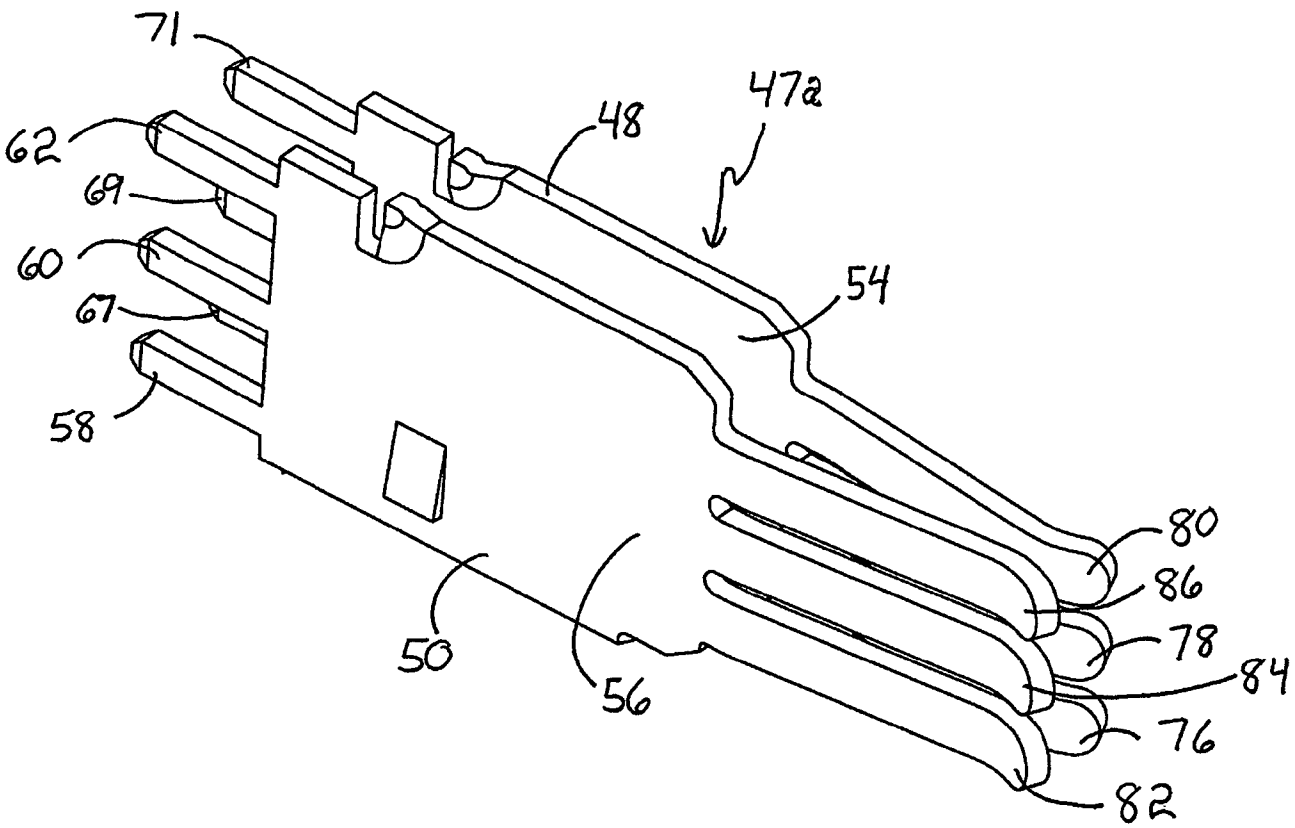
FIG. 6 is a perspective view or another embodiment of a receptacle contact pair, showing two uncoupled receptacle contact members.

In some embodiments, such as shown in FIGS. 5, 5A and 5B, beams 76, 78 and 80 and beams 82, 84 and 86 extend from respective edges of the back panels or body panels 54 and 56 that are orthogonal to the edges of panels 54 and 56 from which the tails extend. The tails of this embodiment typically are solder tails or compliant tails. This orthogonal relative orientation of the beams and tails is used for parallel board connection. In other embodiments, such as shown in FIG. 6, a contact is provided, generally designated as contact 47*a*, the beams 76, 78 and 80 and beams 82, 84 and 86 extend from respective edges of panels 54 and 56 that are opposite of the edges of panels 54 and 56 from which tails 67, 69 and 71, and tails 58, 60 and 62 extend, respectively. The tails in this embodiment are typically solder tails or compliant tails. This opposing relative orientation of the beams and tails is used for perpendicular board connection, where one board can be considered a horizontal board and the other a vertical board.

Whether the tails are oriented generally orthogonal or generally in line with the beams, the beams extend from the back panels or body panels 54, 56. When considering the combination of plug connector and receptor connector, and viewed in the direction out of the receptacle connector 11 and toward the plug connector 10 (or inwardly), beams 76, 78 and 80 and beams 82, 84 and 86 first extend from the respective panels 54 and 56 inwardly toward the opposing beam of the opposing contact and then outwardly away from the opposing beam. The sections of the opposing beams that extend outwardly form camming surfaces 88 and 90 first contact a plug connector during mating. In an illustrated embodiment, the camming surfaces 88, 90 engage blade 46 of the plug connector 10. Proper mating action proceeds, with the camming surfaces helping to guide blade 46 to enter receptacle connector 11. Thereafter, the blade 46 encounters restriction portions 92 and 94 of beams 80 and 86, respectively. Substantially simultaneously, like restriction portions of beams 76, 78 and 82, 84 respectively are encountered by the blade 46. This mating typically is completed when opposing surfaces of the plug connector 10 and receptacle connector 11 contact each other to stop any further movement of the plug connector and/or receptacle connector toward each other.

Figure 7:
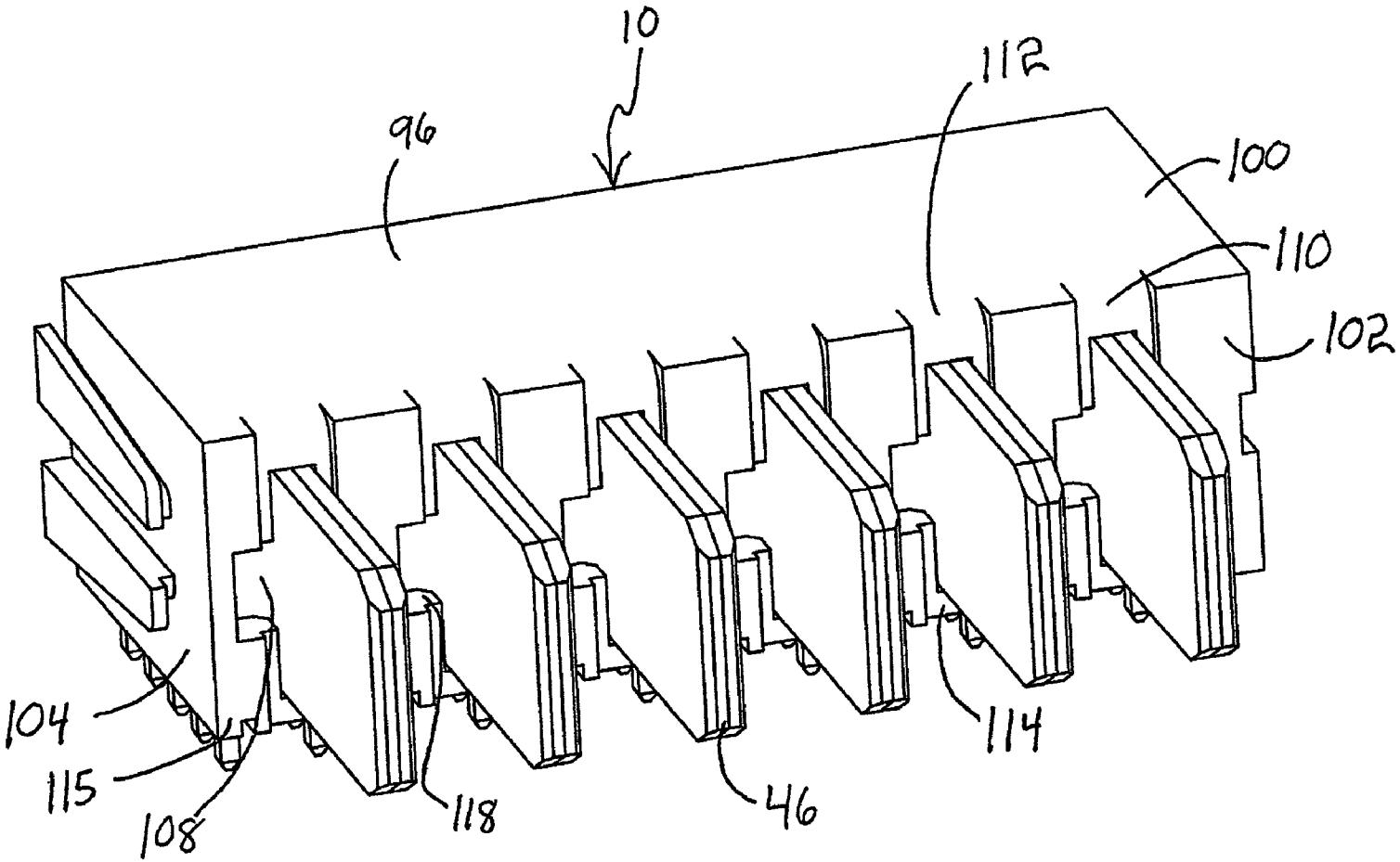
FIG. 7 is a perspective view of a plug connector having a plurality of plug contacts in an insulative housing.
Figure 7A:
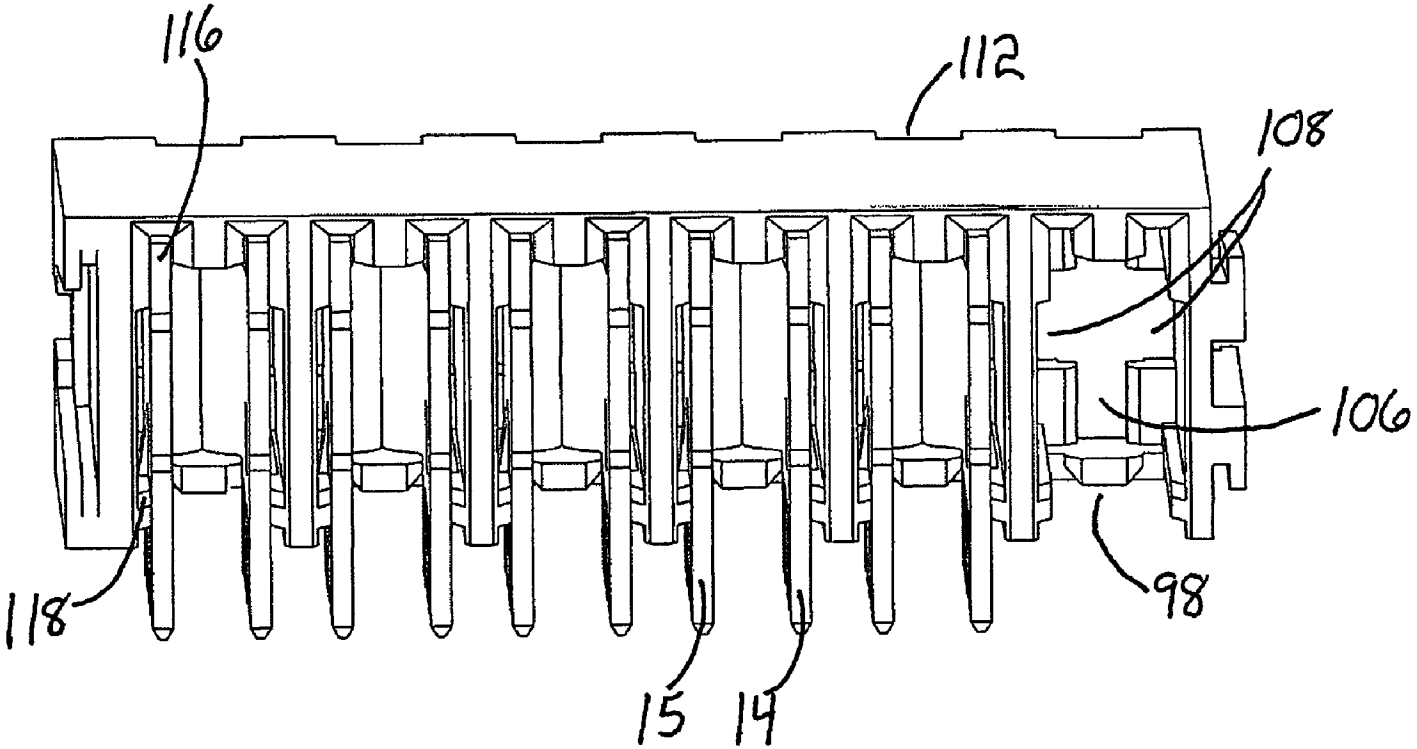
FIG. 7A is a perspective view, partially broken away, of the edges of plug contacts in insulative housing.

Referring to FIGS. 7 and 7A, plug connector 10 includes insulative plug housing 96 that has a top wall 100, a front wall 102 and side walls 104. Housing 96 also has one or more tunnel like cavities 98 that extend through the back and bottom of housing 96 and extend close to but not through top wall 100, front wall 102 and sidewall 104. Front wall 102 has aperture 106 at each section that is large enough for blade 46 to pass through. Front wall 102 also has two smaller apertures 108 at each section that allow for probes to be inserted into housing 96. Front wall 102 in addition has an indentation 110 at each section that extends from top to bottom and forms a top aperture 112 and a bottom aperture 114 therealong. A housing channel 116 and a housing shoulder or projection 118 in housing 96 assist in positioning each pair of contact members 14 and 15. Contact members 14 and 15 are spaced apart from side walls of cavities 98. In this illustrated plug connector embodiment, a side barb or projecting member 117 on one or both of contact members 14 and 15 is shown, for example in FIG. 3, toward the bottom of the panels riding on housing shoulder 118 to lock contact members 14 and 15 vertically while providing air space around the contact members. Contact members 14 and 15 are positioned slightly above a board component such as PCB 148 shown in FIG. 3 when in use to assist in providing a slight spacing 150 from the PCB or the like. Such spacing assists with proper solder flow while also providing air volume for heat dissipation and typically is facilitated by providing standoffs 115.

This illustrated plug connector embodiment also provides a barb or a projecting member 120 on each or both of contact members 14 and 15, as shown for example in FIG. 1A. Each such barb or member 120 fits within housing channel 116 and engages wall 121 (FIG. 4) of housing 17 to prevent horizontal movement of contact members 14 and 15 within the connector housing 96. Maintaining proper positioning helps to assure correct alignment and air space around the contact members, and same can contribute to reducing size requirements. When tails are soldered in place, such as onto a board connector such as PCB 148, the housing shoulders and the housing channels can be positioned such that housing 96 is positioned slightly above the PCB so there exists a slight space between housing 96 and the PCB, typically with the assistance of the standoff 115 as noted herein.

Figure 8:
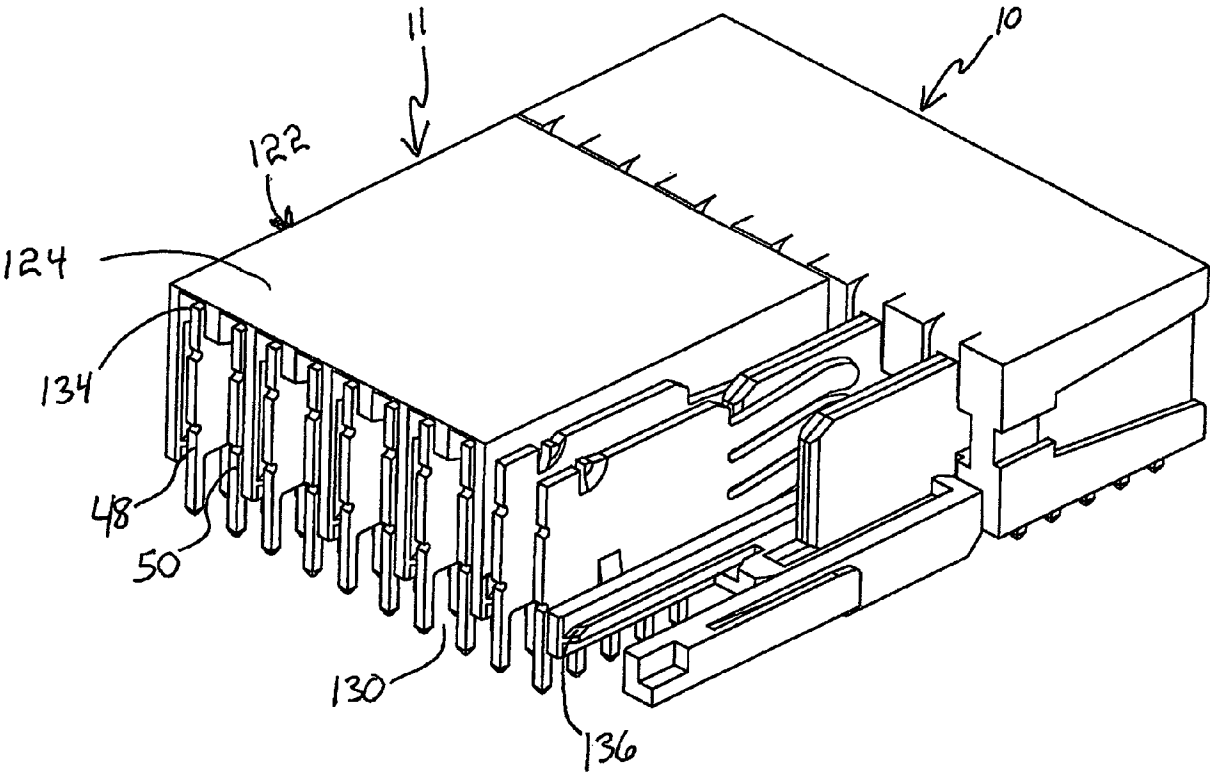
FIG. 8 is a perspective view of a plug connector and of a receptacle connector with receptacle contacts in insulative housing, partially broken away, the receptacle contacts shown in engagement with blades of the plug connector.
Figure 8A:
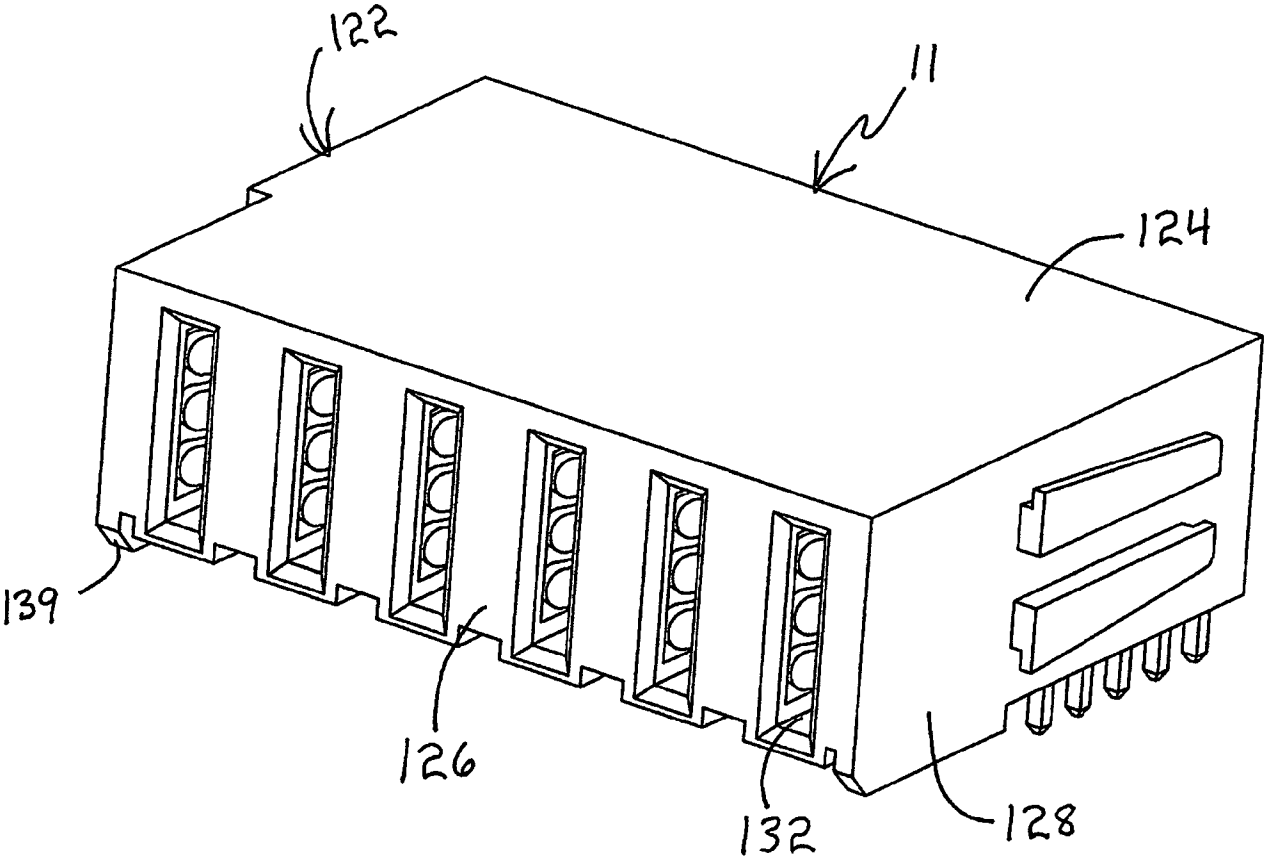
FIG. 8A is a perspective view of the receptacle connector of FIG. 8, rotated 180 degrees, showing receptacle contacts in an insulative receptacle housing.

Referring to FIGS. 8 and 8A, receptacle connector 11 has insulative receptacle housing, generally designated at 122, that has a top wall 124, a front wall 126 and side walls 128. Housing 122 also has one or more tunnel like cavities 130, typically one at each section, that extend through the back and bottom of housing 122 and extend close to but not through top wall 124, front wall 126 and side walls 128. Front wall 126 has aperture 132 at each section just large enough for blade 46 from plug connector 10 and only minimal air to pass through.

Figure 8B:
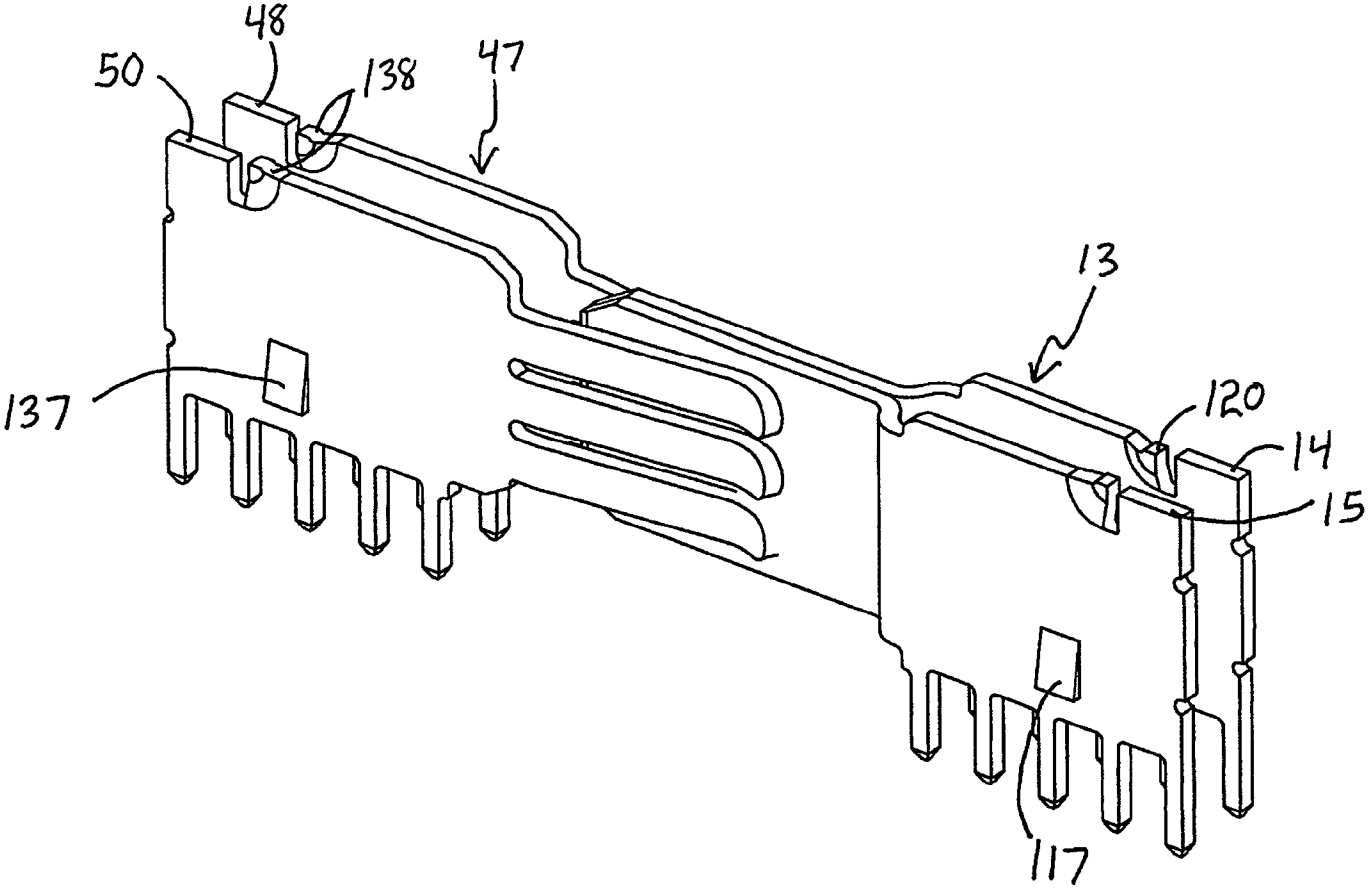
FIG. 8B is a perspective view of embodiments of contacts shown in a mated configuration, with the respective housings being removed to provide more detailed views of uncoupled panels in both contacts seen in FIG. 8.

Housing channel or top slots 134 and housing shoulder or projection 136 position contact members 48 and 50 in each section of housing 122. Contacts 47 comprised of contact members 48 and 50 are spaced apart from side walls of cavities 130 at each section. Barbs 137 are shown in this illustrated embodiment on contact members 48 and 50, as shown in FIG. 8B, ride on housing shoulder 136 and lock contact members 48 and 50 vertically. Contact members 48 and 50 are positioned slightly above the PCB when in use to assist in providing clearance from the PCB. Such typically is facilitated by including at least one standoff 139.

This illustrated receptacle connector embodiment also provides a barb 138 in one or each of contact members 48 and 50 that fits within housing channel 134 at each section to prevent horizontal movement of contact members 48 and 50 within housing 122, while providing air space around the contact members 48 and 50. When tails are soldered in place, the contact barbs, the housing shoulders and the housing channels can be positioned such that housing 122 is positioned slightly above the PCB 148 so there exists a slight space between housing 122 and the PCB. FIG. 8B shows a typical mating engagement between plug contact 13 and receptacle contact 47 and provides an unobstructed view of an embodiment of these components.

Figure 9:
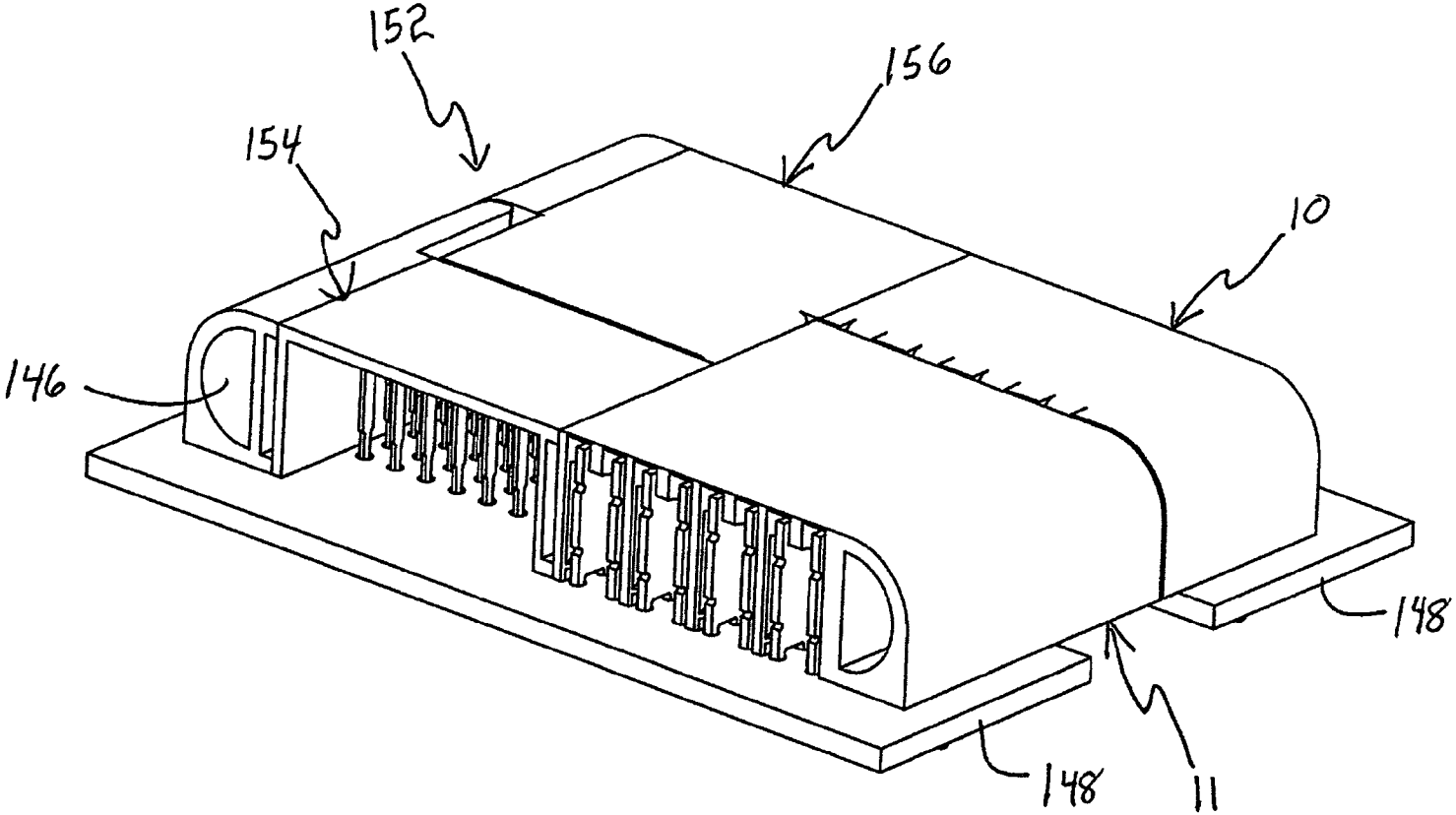
FIG. 9 is a perspective view of an embodiment including an assembly of various modular components including a plug connector and a receptacle connector connected to a printed circuit board.
Figure 10:
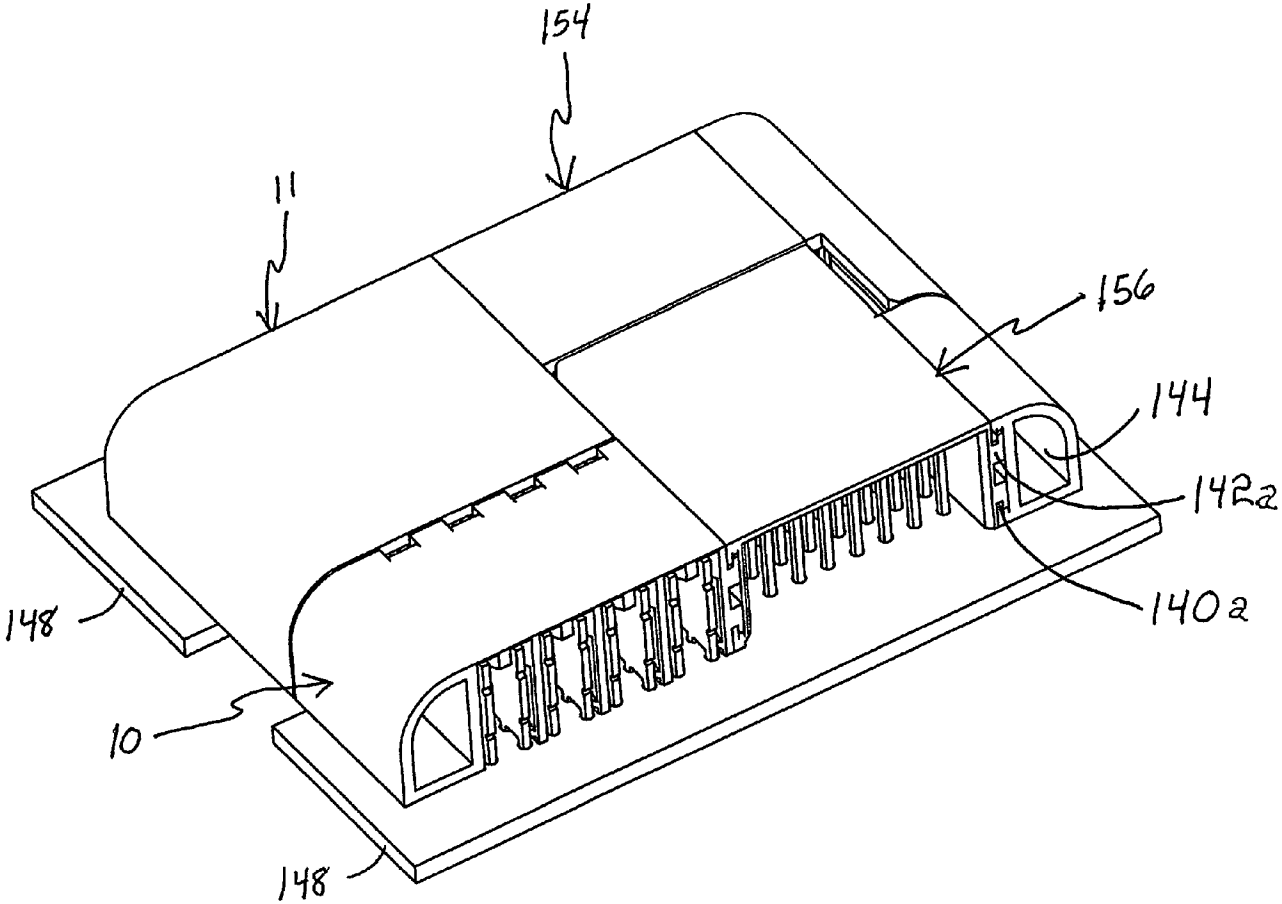
FIG. 10 is another, differently oriented perspective view of the assembly embodiment illustrated in FIG. 9.
Figure 11:
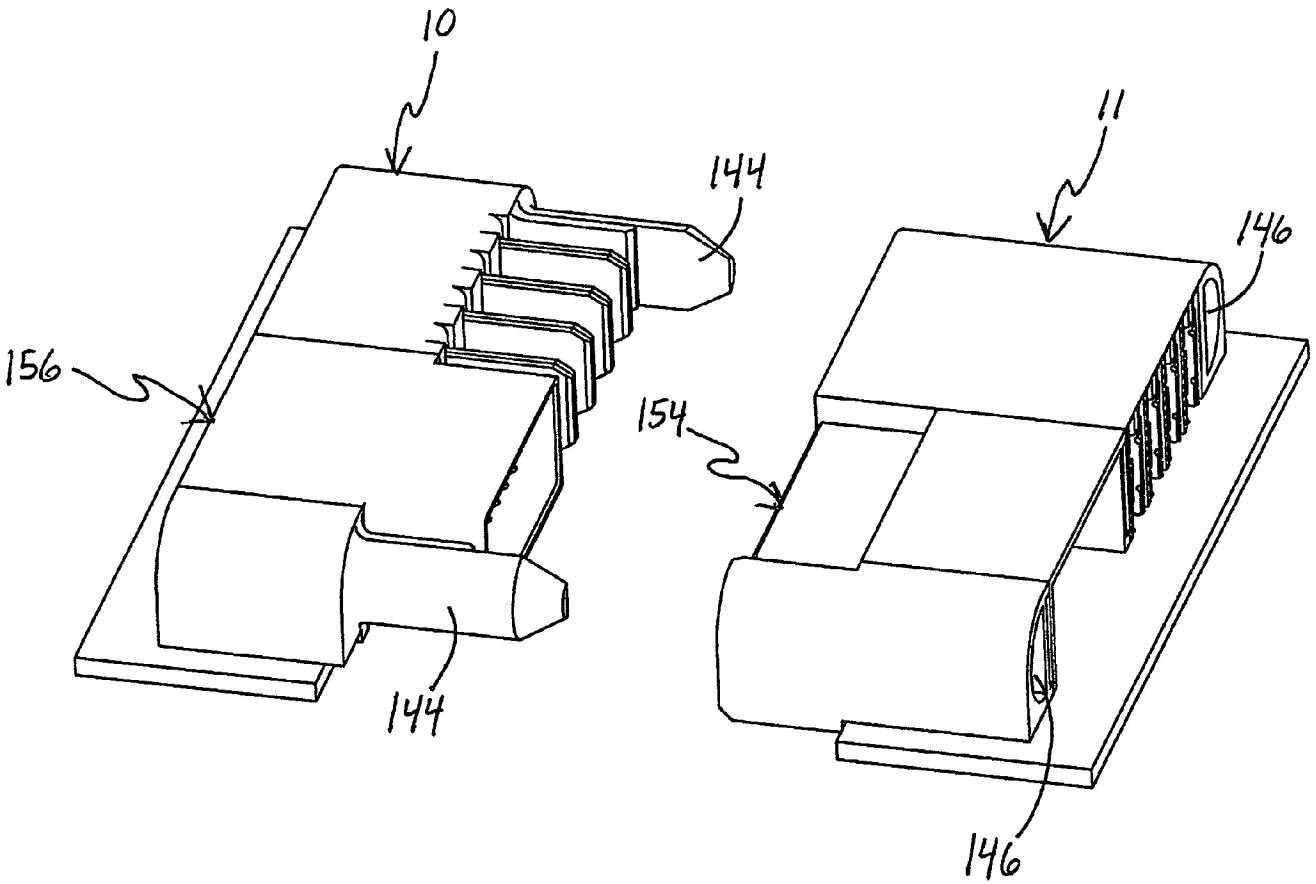
FIG. 11 is an exploded perspective view of another orientation of the assembly embodiment illustrated in FIG. 9.
Figure 12:
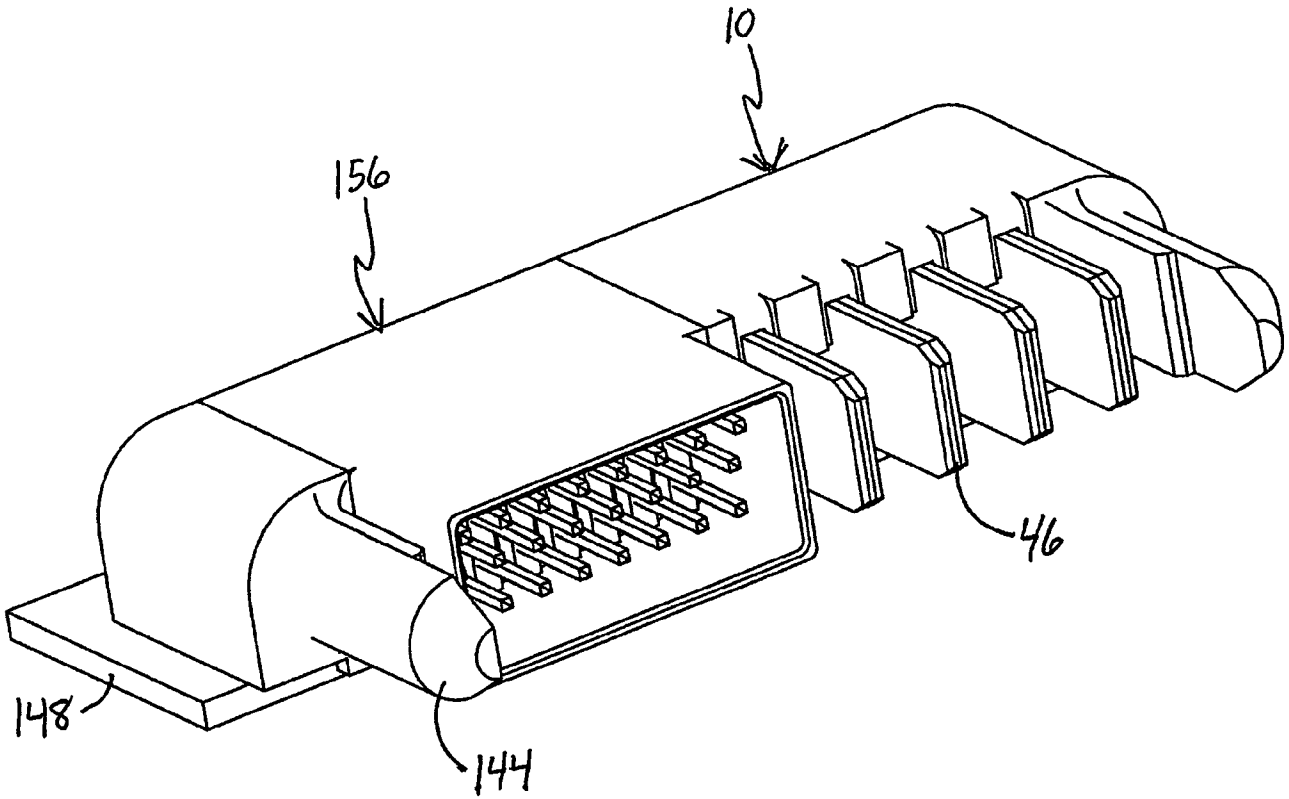
FIG. 12 is a perspective view of one of the exploded assemblies of FIG. 11, at another different orientation.
Figure 13:
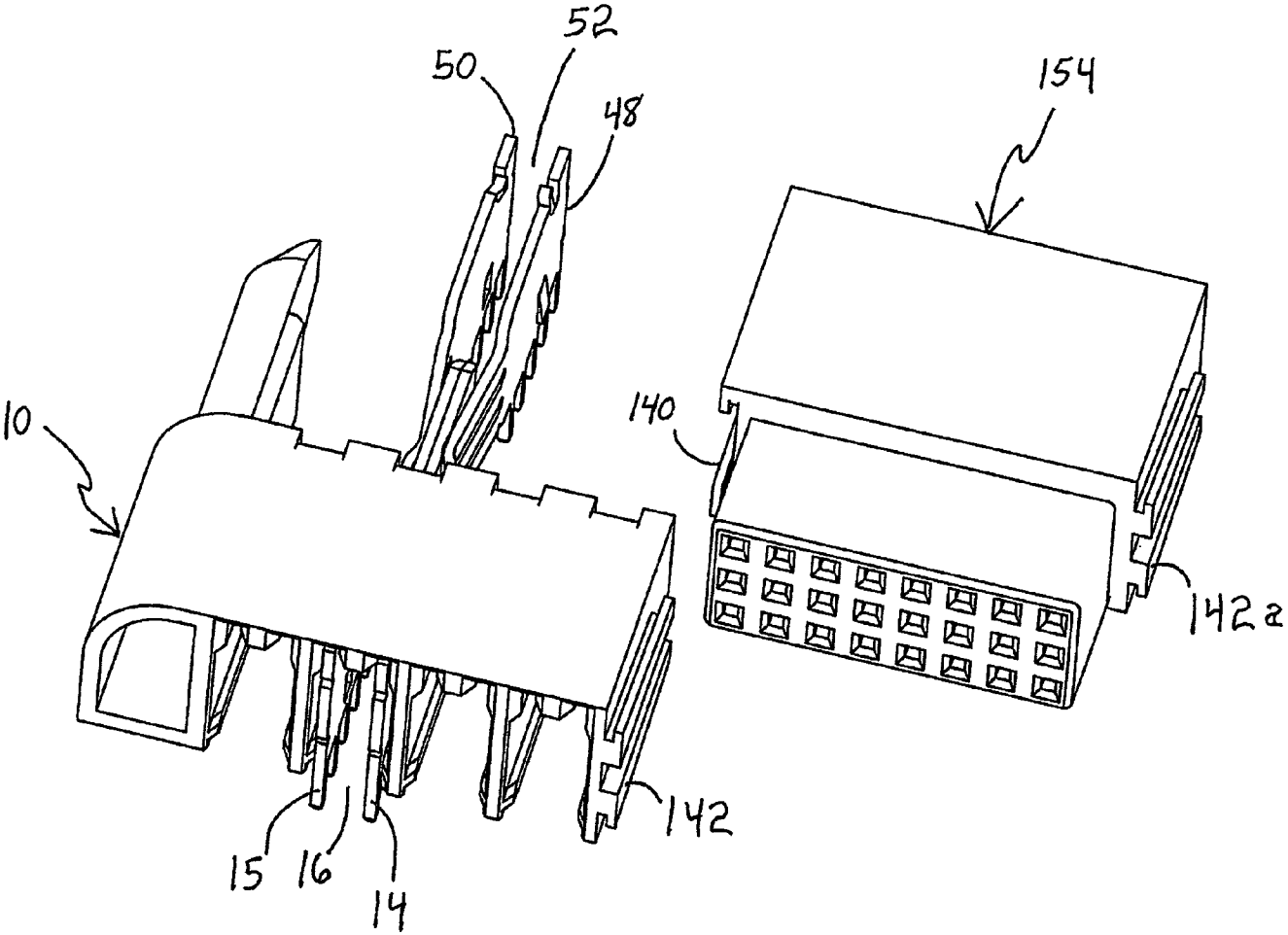
FIG. 13 is a perspective view of two modules from FIG. 9, illustrating a dovetail assembly embodiment.
Figure 14:
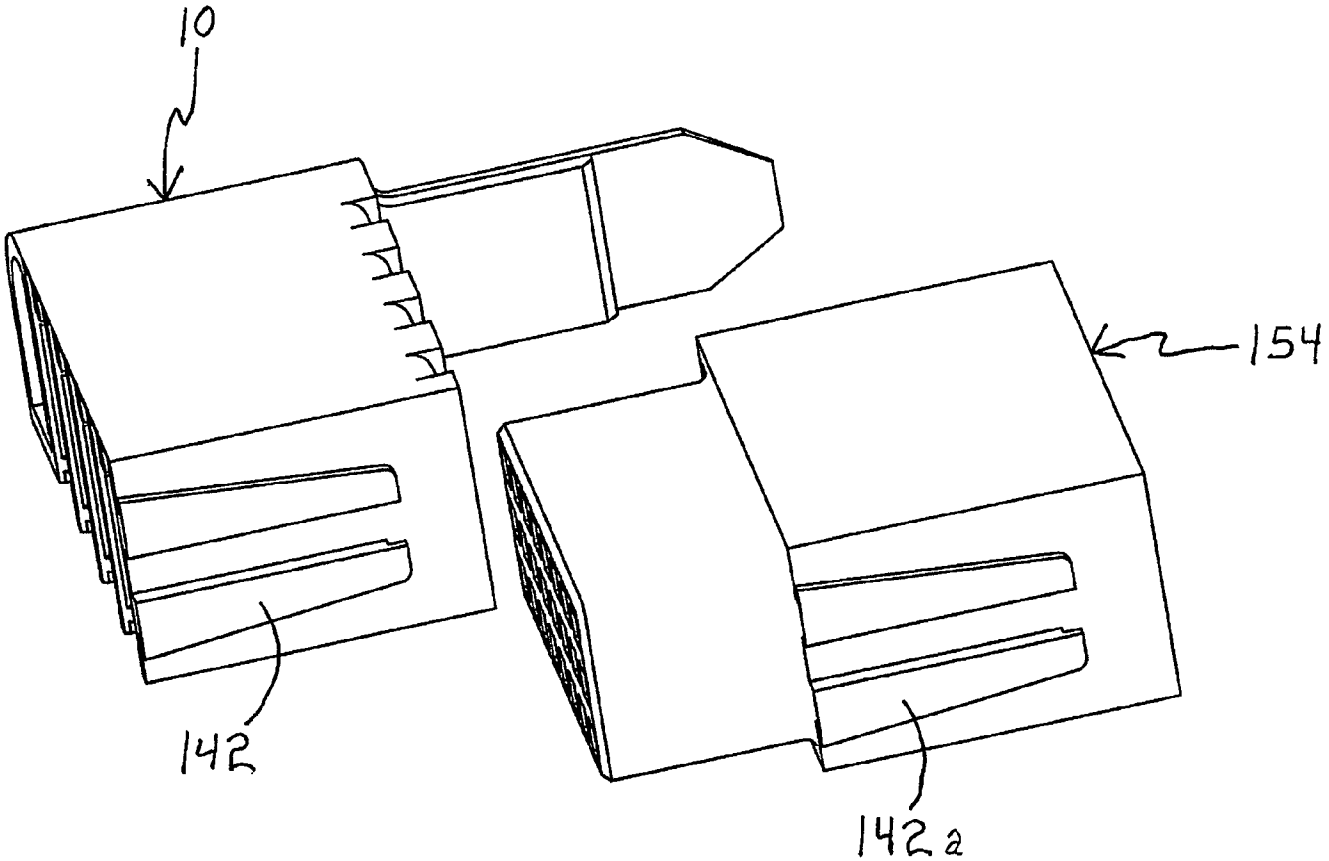
FIG. 14 is another perspective view of an embodiment of modular components as generally shown in FIG. 13.

Referring to FIG. 9, a plug connector 10 and a receptacle connector 11, shown in a power connector assembly 152, can be used in a modular manner by placing complementary interlocking connectors such as interlocking dove tails 140 and 142 on respective outer sides of the plug housing and on respective outer sides of the receptacle housing. This modular housing approach provides product flexibility with ease of manufacturing and low tooling cost. If desired, signal connectors, generally designated as 154, 156, can be in the same assembly as the power contacts by providing signal modules and by interconnecting such signal modules with a power module, such as by incorporating dovetails 140, 140*a*, 142 and 142*a* (FIGS. 10, 13, 14). Multiple signal modules and power modules can be assembled to provide a power connector assembly, with or without signal modules.

As seen in FIG. 10 for example, guide posts 144 on the housing of the plug connector 10 and guide post receptors 146 on the housing of the receptacle connector 11 may optionally be used for ease of mating. One or more guide posts can be added with corresponding guide post receptors to further aid in alignment and mating. Typically the guide post and post receptors system will incorporate dovetails 140*a* and 142*a*. When the guide posts and receptors are added to the tops of modules, this helps to preserve board space such as by minimizing width. When the guide posts and receptors are positioned on the sides of modules, better air flow can be realized.

Electrical current flows through a plug connector 10 and/or a receptacle connector 11 when it is put into use, typically as mated together, heat is generated due to the Joule effect. The generated heat, if not dissipated, can cause temperature rise and limit current flow because only limited temperature rise can be tolerated. A cross flow of air over the exposed surfaces of the contact members 14 and 15 and/or 48 and 50 for example will dissipate the generated heat and limit temperature rise. Air can enter the cavities 98 and/or 130 through their rear openings and pass over the contacts such as 14, 15 and/or 48 and 50. Air also will exit from rear openings of the cavities 98 and/or 130. In addition, some air will escape from the apertures 112 and/or 114 in the top and bottom walls of the plug cavities thus dissipating heat. When assembled onto a board component such as a PCB, a slight airspace or clearance between contacts 14 and 15 and/or 48 and 50 and the PCB to which they are connected and a slight airspace or clearance between housing 96 and/or housing 122 and the PCB to which they are connected can aid in improving airflow. Heat dissipation is further realized by the uncoupled contact member pairs that are provided by the present structure, especially when the uncoupled characteristic is combined with open volumes that are provided on the faces of the contact members that are opposite of the opposing uncoupled faces of those same contact members that define the medial space. In this way, each contact member face is directly engaged by minimal solid matter, leaving additional open air volume for heat dissipation.

Figure 15:
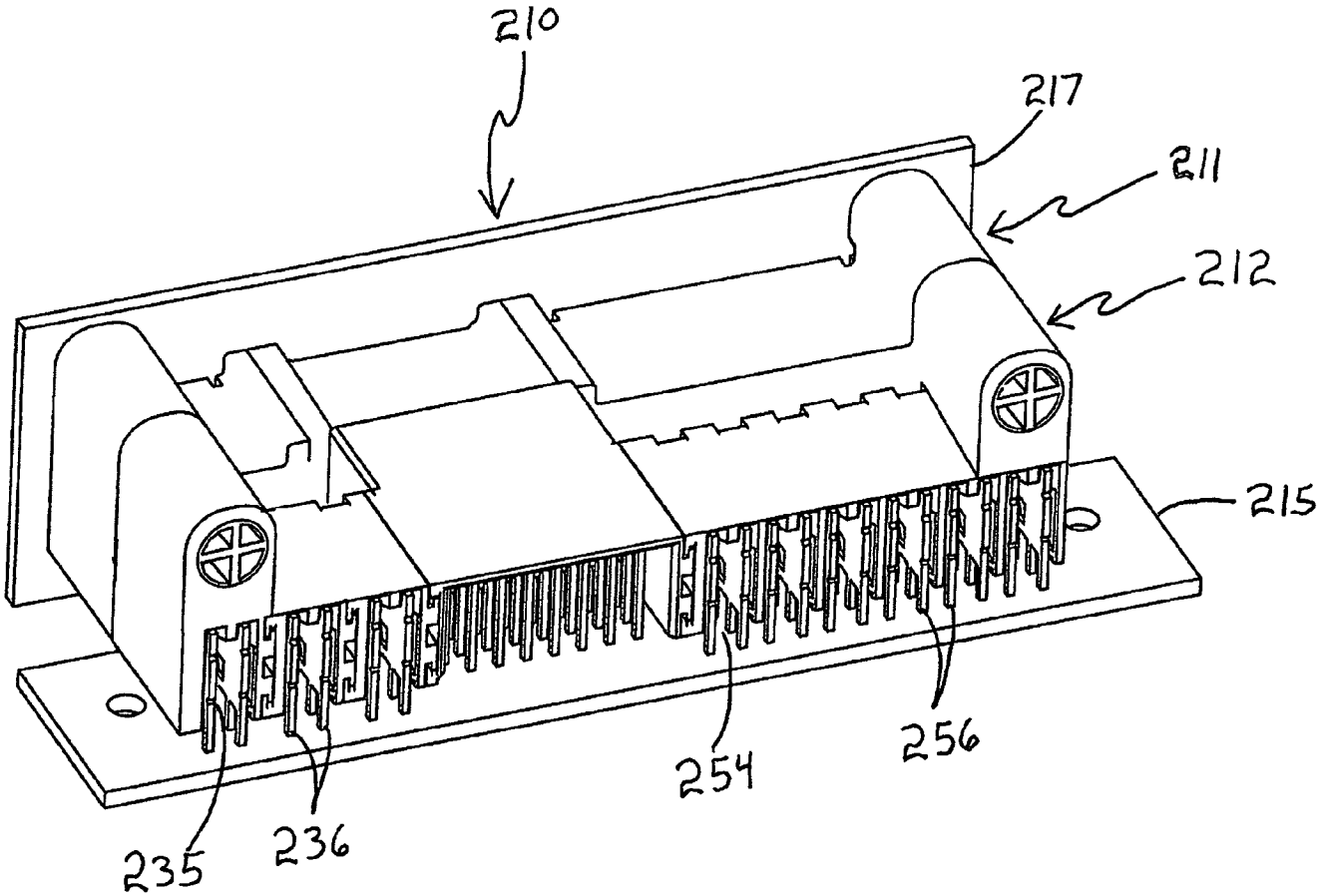
FIG. 15 is a perspective view of another embodiment including a modular receptacle connector assembly coupled to a modular plug connector assembly.

FIG. 15 represents a modular connector system, generally designated as 210, that comprises a modular receptacle connector assembly, generally designated as 211, and a modular plug connector assembly, generally designated as 212. Modular plug assembly 212 is shown connecting PCB or mother board 215, considered horizontal, to PCB or daughter board 217, considered to be vertical. Modular connector system 210 is thus shown as one modular piece that connects two PCBs at a right angle.

Figure 16:
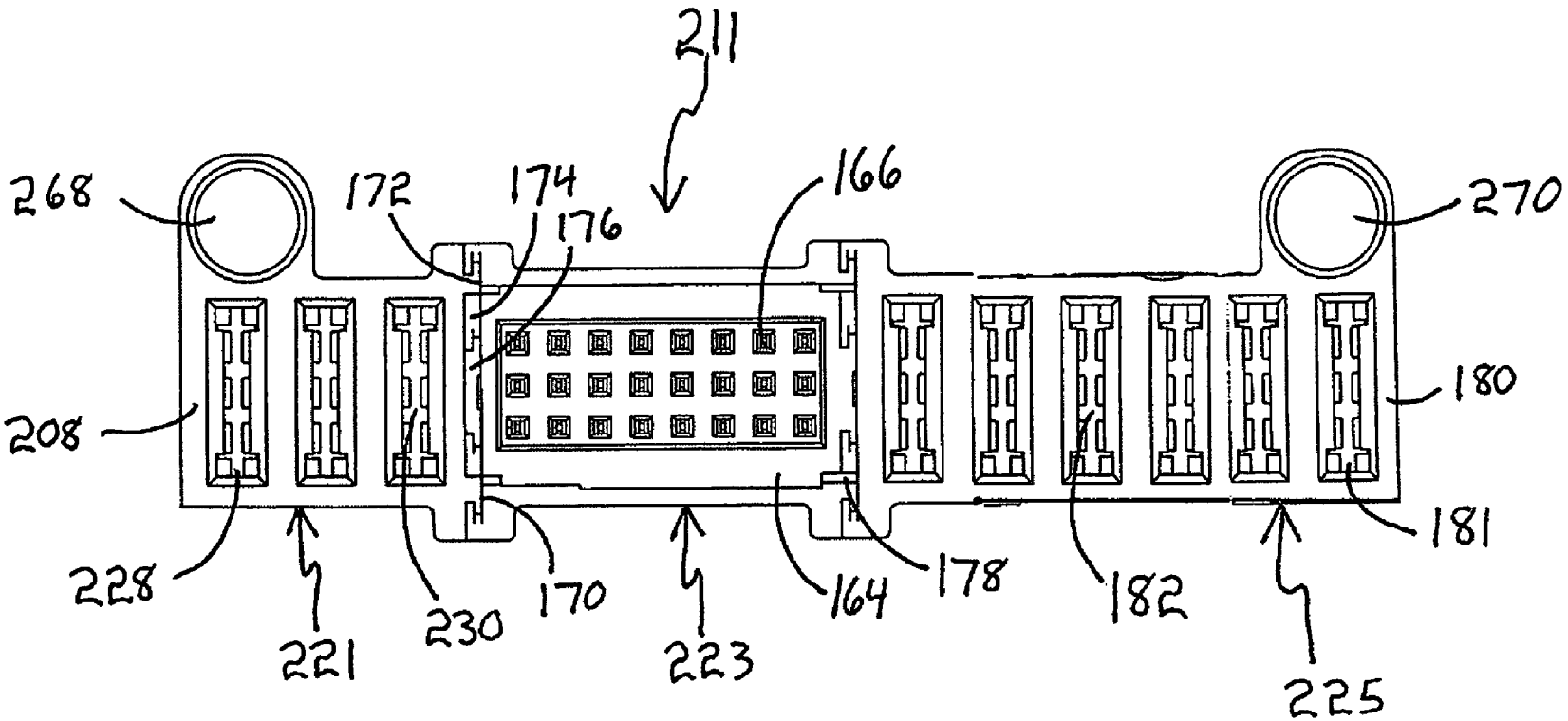
FIG. 16 is a side elevation view of the modular receptacle connector assembly shown in FIG. 15.

In an embodiment, FIG. 16 illustrates receptacle connector assembly 211 comprised of three interconnected modules, power receptacle module for DC input power, generally designated as 221, receptacle module for electrical signal, generally designated as 223, and receptacle module for DC ground return, generally designated as 225. DC power receptacle module 221 has insulative housing 208. DC power receptacle module 221 has a plurality of cavities 228 in housing 208 to seat DC power receptacle contacts 230 (FIG. 16).

DC power input of power receptacle module 221 as shown in FIG. 16 suitably comprises one set of contacts to provide one DC power supply. Said DC power supply provides between about 500 and about 2200 watts and typically between about 800 and about 1500 watts, with the current divided substantially equally over the input contacts. Suitably the DC receptacle contacts have a pitch of about 6.0 mm.

Signal module 223 has insulative housing 164 and suitably contains between about 6 and about 40 mated signal contacts and typically between about 18 and about 32 signal receptacle contacts 166. Side 170 of signal receptacle housing 164 interconnects to side 172 of power input receptacle housing 208, as shown in FIG. 16. Side 170 and side 172 have mating dove tail members 174 and 176. This modular housing approach provides product flexibility with ease of manufacturing and low tooling cost. Secondary interlocking features such as clips 178 (FIG. 16) at the bottom of the module 223 are also employed to aid in proper alignment of the modules and increase the strength of the interlock. All side by side aligned modules in modular connector system 210 may be interlocked employing these features.

DC ground return receptacle module 225 (FIG. 16) has insulative housing 180 with cavities 181 for seating DC ground receptacle contacts 182. These DC ground receptacle contacts transmit ground power return of about 500 to about 2200 watts and typically between about 800 and about 1500 watts, and the current is divided substantially equally among the ground receptacle contacts. Opposite the mating portion of the ground return receptacle contacts, the contacts have a plurality of compliant pins for insertion into a board considered to be vertical. DC power input receptacle contacts 230 and DC ground return receptacle contacts 182 align substantially in a row.

Figure 17:
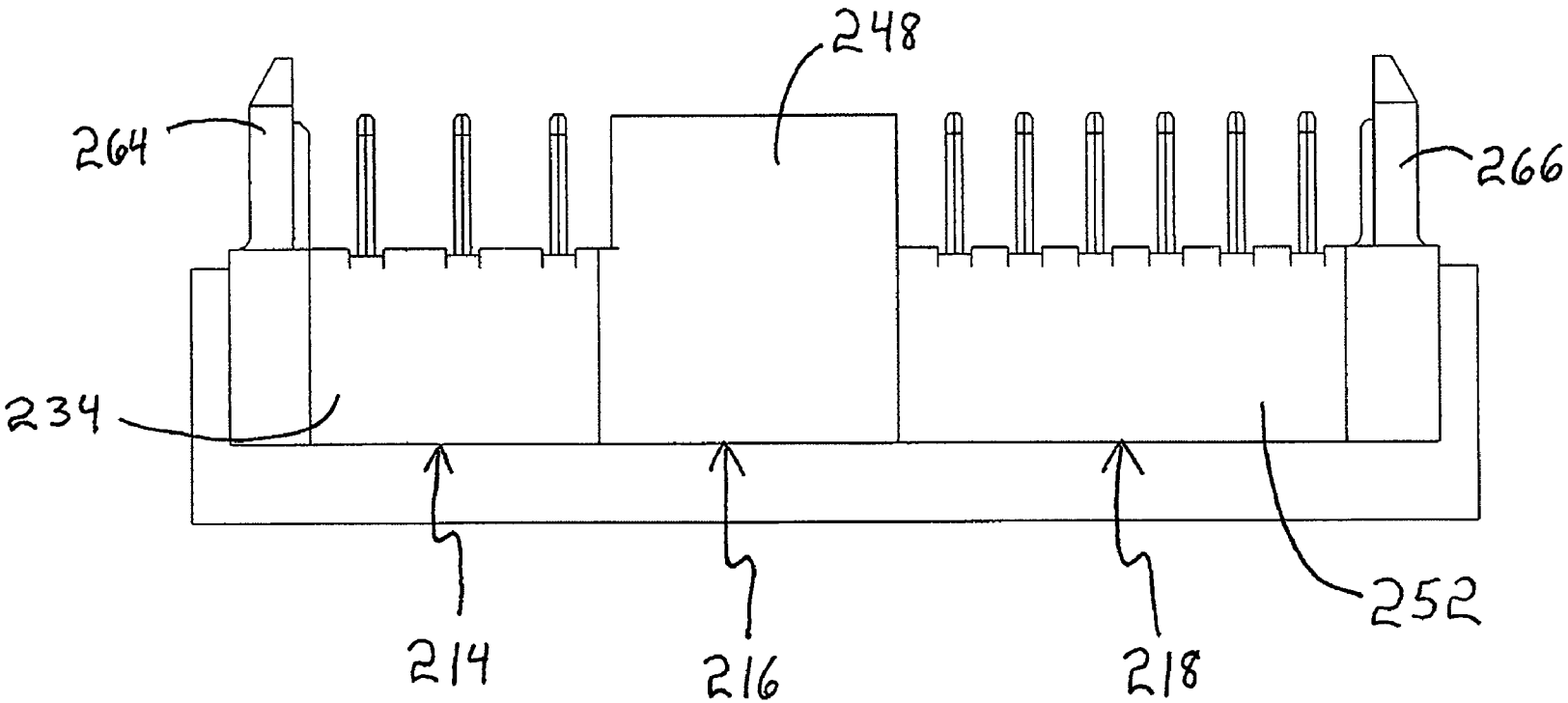
FIG. 17 is a top plan view of another embodiment of a modular receptacle connector assembly.

As shown in FIG. 15 and 17, DC power plug module 214 has insulative housing 234 with cavities 235 to seat DC power plug contacts 236. Electrical signal plug module 216 has signal plug housing 248 that incorporates between about 6 and about 40 mated signal contacts and typically between about 18 and about 32 signal contacts. DC ground module 218 has insulative housing 252 with cavities 254 to seat DC ground plug contacts 256.

Guide posts 264 and 266 (FIG. 17) on the housing of the plug modules 214 and 218, respectively, and guide post receptors 268 and 270 (FIG. 16) on the housing of the receptacle modules 221 and 225, respectively, may optionally be used for ease of mating. One or more guide posts can be added with corresponding guide post receptors to further aid in alignment and mating. When the guide posts and receptors are added to the tops of modules, this helps to preserve board space such as by minimizing width.

In another aspect or embodiment, modular connector system 210 shown in FIG. 15 has a height of between about 12 and about 25 mm off the board and typically between about 18 and about 22 mm off the board.

It will be understood that there are numerous modifications of the illustrated embodiments described above which will be readily apparent to one skilled in the art, such as many variations and modifications of the power connector and/or its components including combinations of features disclosed herein that are individually disclosed or claimed herein, explicitly including additional combinations of such features, or alternatively other types of power connectors. Also, there are many possible variations in the materials and configurations. These modifications and/or combinations fall within the art to which this invention relates and are intended to be within the scope of the claims which follow.

The invention claimed is:

1. A plug connector comprising:

an insulative plug connector housing and a plug contact located at least partially within the insulative plug housing, the contact having a pair of contact members each having a blade portion and a panel portion, the plug connector contact is seated in the plug connector housing;

the panel portion of the plug connector contact has a pair of uncoupled contact panels that define a medial space therebetween;

the uncoupled contact panels of the plug connector are in substantially parallel planes and have a converging side from which the blade portion extends, the blade portion of each contact member being uncoupled to the other; and said contact panels each have a plurality of mechanically uncoupled sides, and at least one of the contact panels has at least one tail extending therefrom.

2. The plug connector of claim 1, wherein the uncoupled contact panel having an extending tail and the converging side are substantially opposite each other.

3. The plug connector of claim 1, wherein the uncoupled contact panel having an extending tail and the converging side are substantially orthogonal to each other.

4. The plug connector of claim 1, wherein the plug connector housing has a plug cavity that extends through a back wall and a bottom wall of the plug connector housing and extends close to but not through a top wall, a front wall and a side wall of the plug connector housing and seats the plug contacts.

5. The plug connector of claim 1, wherein the plug connector housing has a housing channel, the plug contact has an upper barb, and the upper barb fits within the housing channel to seat the contact horizontally.

6. The plug connector of claim 1, wherein the plug connector housing has a housing shoulder, the plug contact has a lower barb, and the lower barb rides on the housing shoulder to seat the contact vertically.

7. The plug connector of claim 1, wherein the plug connector housing includes a standoff that engages a surface of a board component such that there is a space between the contacts and the surface of the board component.

8. The plug connector of claim 1, wherein the plug connector housing includes a standoff that engages a surface of a board component, the tail is soldered to the board component, and said plug connector housing is positioned above the surface to which the tails are soldered such that there exits a space between the housing and the surface.

9. The plug connector of claim 4, wherein a front wall of the plug cavity has an aperture large enough for the plug blade to pass through.

10. A connector comprising:

a housing having a first opening, the first opening including a first channel aligned with a first projection and a second channel aligned with a second projection, the housing further including a second opening, the first opening in communication with the second opening so as to provide a passage through the housing;

a first terminal with a first contact portion and a first panel, the first panel including a first edge and a second edge, the first edge positioned in the first channel, the first terminal including a first barb configured to positioned the first terminal in the first channel, the first terminal further including a plurality of tails extending from the second edge, the first terminal extending along the first projection and extending substantially between the first opening and the second opening; and a second terminal with a second contact portion and a second panel that includes a first edge and a second edge, the second contact portion mechanically uncoupled from the first contact portion of the first terminal, the first edge positioned in the second channel, the second terminal including a second barb configured to position the second terminal in the second channel, the second terminal further including a plurality of tails extending from the second edge, the second terminal extending along the second projection and extending substantially between the first opening and the second opening, wherein the tails of the first and second terminal are configured in operation to engage a circuit board and the first and second panel terminal are spaced apart and define a medial space in the housing.

11. The connector of claim 10, wherein the first panel and the second panel are substantially parallel.

12. The connector of claim 10, wherein opposing sides of the first and second panel are substantially exposed to the medial space, so that, in operation, heat may be transferred from a substantial portion of the first and second panels without passing through the housing.

13. The connector of claim 10, wherein the first terminal further includes a second barb configured to be supported by the first projection and the second terminal includes a second barb configured to be supported by the second projection.

14. The connector of claim 10, wherein the second opening is positioned in a face of the housing and the first and second terminal extend through the second opening and project away from the face.

15. The connector of claim 14, wherein the contact portions of the first and second terminal are in close physical proximity so as to form a blade.

* * * * *